US008096541B2

(12) United States Patent
Taguchi et al.

(10) Patent No.: US 8,096,541 B2
(45) Date of Patent: Jan. 17, 2012

(54) SHEET FOLDING APPARATUS, SHEET FOLDING METHOD, AND IMAGE FORMING APPARATUS

(75) Inventors: Hiroyuki Taguchi, Kawasaki (JP); Yasunobu Terao, Izunokuni (JP); Shinichiro Mano, Hadano (JP); Takahiro Kawaguchi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 729 days.

(21) Appl. No.: 12/182,780

(22) Filed: Jul. 30, 2008

(65) Prior Publication Data

US 2009/0033015 A1 Feb. 5, 2009

Related U.S. Application Data

(60) Provisional application No. 60/952,836, filed on Jul. 30, 2007, provisional application No. 60/968,541, filed on Aug. 28, 2007, provisional application No. 60/968,853, filed on Aug. 29, 2007, provisional application No. 60/969,126, filed on Aug. 30, 2007, provisional application No. 60/969,148, filed on Aug. 30, 2007, provisional application No. 60/980,727, filed on Oct. 17, 2007.

(51) Int. Cl.
*B65H 37/04* (2006.01)

(52) U.S. Cl. ..... 270/37; 270/20.1; 270/32; 270/45; 270/58.07

(58) Field of Classification Search ..... 270/20.1, 270/32, 37, 45, 51, 58.07
See application file for complete search history.

(56) References Cited

U.S. PATENT DOCUMENTS

| | | | | |
|---|---|---|---|---|
| 6,712,349 | B2 * | 3/2004 | Watanabe | 270/37 |
| 6,799,759 | B1 * | 10/2004 | McNamara et al. | 270/58.08 |
| 7,828,276 | B2 * | 11/2010 | Iguchi et al. | 270/58.09 |
| 2004/0188911 | A1 * | 9/2004 | McNamara et al. | 270/58.08 |
| 2004/0254054 | A1 | 12/2004 | Suzuki et al. | |
| 2007/0280805 | A1 * | 12/2007 | Sasamoto et al. | 412/11 |

FOREIGN PATENT DOCUMENTS

| | | |
|---|---|---|
| JP | 5-85082 | 4/1993 |
| JP | 11-292379 | 10/1999 |
| JP | 11-292387 | 10/1999 |
| JP | 2001-19268 | 1/2001 |
| JP | 2001-122515 | 5/2001 |
| JP | 2004-131292 | 4/2004 |
| JP | 2004-269186 | 9/2004 |
| JP | 2004-284756 | 10/2004 |
| JP | 2005-1841 | 1/2005 |

OTHER PUBLICATIONS

Japanese Patent Application No. 2008-196917 Official Action dated Aug. 23, 2011 (English translation attached).

* cited by examiner

*Primary Examiner* — Leslie A Nicholson, III
(74) *Attorney, Agent, or Firm* — Patterson & Sheridan, LLP

(57) ABSTRACT

A sheet folding apparatus including a sheet supporting member which has an inclined surface to support a stack of sheets, a sheet position adjuster which adjusts a position of the stack of sheets along the inclined surface, a sheet pressing unit which presses the stack of sheets against the inclined surface, a folding unit which folds the stack of sheets pressed by the sheet pressing unit, and a controller which controls the sheet pressing unit to press the stack of sheets on the sheet position adjuster against the inclined surface, and to create a gap between the stack of sheets on the sheet position adjuster and the sheet pressing unit to receive a sheet onto the sheet position adjuster.

19 Claims, 21 Drawing Sheets

SHEET FOLDING APPARATUS, SHEET FOLDING METHOD, AND IMAGE FORMING APPARATUS

CROSS-REFERENCE TO RELATED APPLICATION

This application claims the benefit of U.S. Provisional Applications No. 60/952,836, filed Jul. 30, 2007; No. 60/968,541, filed Aug. 28, 2007; No. 60/968,853, filed Aug. 29, 2007; No. 60/969,126, filed Aug. 30, 2007; No. 60/969,148, filed Aug. 30, 2007; and No. 60/980,727, filed Oct. 17, 2007.

TECHNICAL FIELD

The present invention relates to a sheet folding apparatus, a sheet folding method and an image forming apparatus.

BACKGROUND

In an image forming system, an optional sheet post-process apparatus can be connected to an image forming apparatus such as a multifunction peripheral. Recently, a sheet post-process apparatus is proposed which has a function that aligns ends of a stack of sheets printed by the multifunction peripheral are aligned in length (longitudinal) and width (lateral) directions, and performs saddle stitch binding of the stack of sheets to obtain a booklet.

As the sheet post-process apparatus, US Patent Application Publication No. 2004/0254054A1 discloses a sheet folding device that pushes out a folding plate in the direction perpendicular to a vertical sheet conveying path to insert the sheet or sheet stack between a pair of folding rollers and fold the sheet or sheet stack nipped and fed by the folding rollers.

In the paper folding device, the rear ends (lower ends) of the sheets stacked between stack conveying guide plates disposed along a sheet conveying path are supported by a movable rear end fence and elevated along the sheet conveying path.

Since the sheet having no rigidity (firmness) is buckled on the movable rear end fence, accurate positioning of the sheet stack can not be attained by the elevation control of the movable rear end fence. Also with respect to a curled sheet, accurate positioning of the sheet stack can not be attained by the elevation control of the movable rear end fence. In addition, when a sheet is caught by the sheet conveying guide plate, it becomes difficult to align the lower ends of the sheets.

Further, high-speed conveyance of the sheet stack to the processing position is not attainable in a state where buckling or the like occurs.

SUMMARY

According to an exemplary embodiment, one aspect of the invention relates to a sheet folding apparatus including: a sheet supporting member which has an inclined surface to support a stack of sheets; a sheet position adjuster which adjusts a position of the stack of sheets along the inclined surface; a sheet pressing unit which presses the stack of sheets against the inclined surface; a folding unit which folds the stack of sheets pressed by the sheet pressing unit; and a controller which controls the sheet pressing unit to press the stack of sheets on the sheet position adjuster against the inclined surface, and to create a gap between the stack of sheets on the sheet position adjuster and the sheet pressing unit to receive a sheet onto the sheet position adjuster. Another aspect of the invention relates to a sheet folding method including: supporting a stack of sheets in an inclined position; pressing the stack of sheets against a sheet supporting member; and folding the stack of sheets in a state where the stack of sheets is pressed against the sheet supporting member.

Another aspect of the invention relates to an image forming apparatus including: a printer which prints an image on a sheet; a sheet supporting member which has an inclined surface to support a stack of sheets including the sheet; a sheet position adjuster which adjusts a position of the stack of sheets along the inclined surface; a sheet pressing unit which presses the stack of sheets against the inclined surface; a folding unit which folds the stack of sheets pressed by the sheet pressing unit; and a controller which controls the sheet pressing unit to press the stack of sheets on the sheet position adjuster against the inclined surface, and to create a gap between the stack of sheets on the sheet position adjuster and the sheet pressing unit to receive a sheet onto the sheet position adjuster.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments, and together with the general description given above and the detailed description of the embodiments given below, serve to explain the principles of the invention.

DETAILED DESCRIPTION

Hereinafter, a sheet post-process apparatus of an embodiment will be described with reference to the accompanying drawings. This sheet post-process apparatus is optionally connected to a multifunction peripheral 1001 as an image forming apparatus, and has a function in which ends of a stack of sheets printed by the multifunction peripheral 1001 are aligned in length (longitudinal) and width (lateral) directions, a longitudinal center of the stack of sheets is stapled, and folding is further performed at the longitudinal center portion, and by this, the stack of sheets is bound as a booklet. In this function, stapling is performed at, for example, two places along a folding axis.

Figure 1:
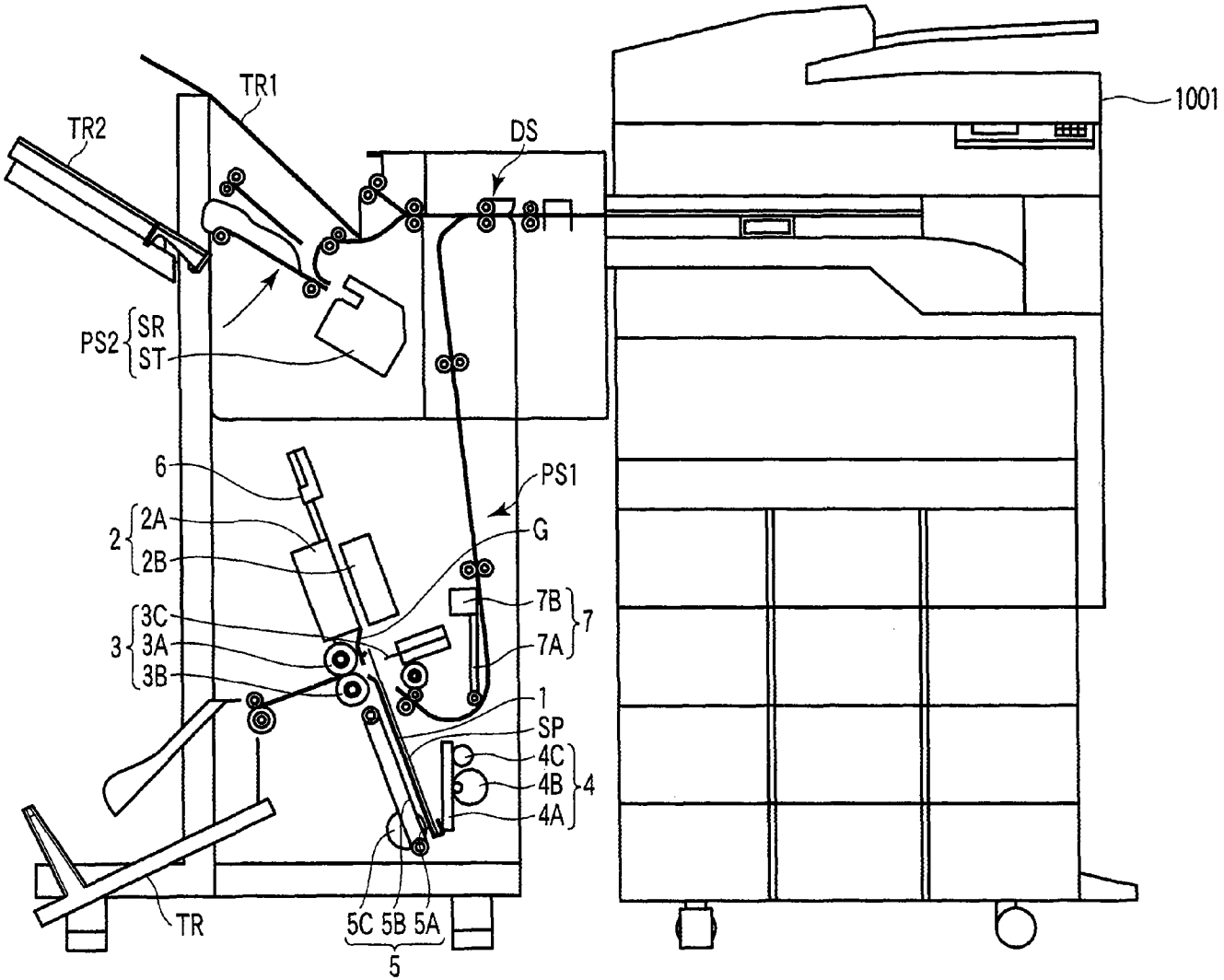
FIG. 1 is an exemplary view showing an inner structure of a sheet post-process apparatus of an embodiment of the invention.
Figure 2:
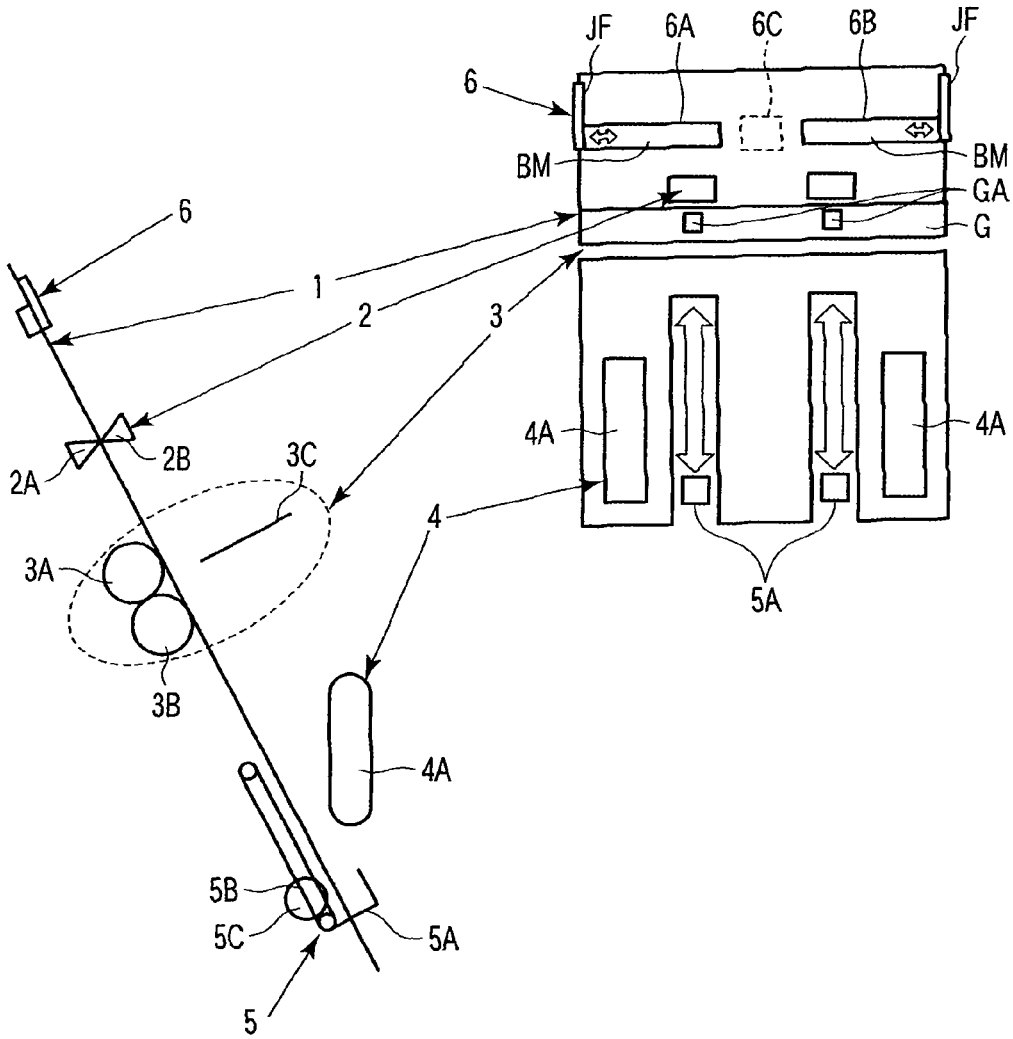
FIG. 2 is an exemplary view schematically showing a main unit of the sheet post-process apparatus shown in FIG. 1.

FIG. 1 shows a front cross-sectional diagram of the sheet post-process apparatus with the multifunction peripheral 1001, and FIG. 2 shows a front cross-sectional diagram at left side, and a right side cross-sectional view at right side, of a main structure of the sheet post-process apparatus. The sheet post-process apparatus includes a sheet folding apparatus PS1 which performs bookbinding of sheets, a finisher device PS2 which sorts or staples the sheets, and a sheet conveying mechanism DS which conveys the sheets to a selected one of the sheet folding apparatus PS1 and the finisher device PS2. The finisher device PS2 includes a sorter SR which sorts the sheets from the sheet conveying mechanism DS by selectively driving conveying rollers to discharge the sorted sheets to sheet trays TR1 and TR2, and a stapler ST which staples the sheets stacked on a tray TR3 by the sorter SR. After stapling, the sorter SR discharges the stapled sheets to the tray TR2.

The sheet folding apparatus PS1 includes a stack plate 1, a stapler 2, a sheet folding unit 3, a sheet pressing unit 4, a sheet position adjuster 5, a lateral alignment unit 6, and a belt conveying section 7. The stack plate 1 has a sheet loading surface 101 which is disposed as an inclined surface of a sheet path. The sheet loading surface 101 is inclined to form a large angle with respect to the horizontal plane. The stapler 2 is disposed along the sheet path and above the sheet folding unit 3. The stapler 2 and the sheet folding unit 3 may constitute a saddle stitch binding process section. The lateral alignment unit 6 is disposed along the sheet path and above the stapler 2. The sheet pressing unit 4 is disposed at a lower part of the stack plate 1. The sheet position adjuster 5 is disposed along the sheet path and below the sheet folding unit 3. The stapler 2 and the sheet folding unit 3 served as the saddle stitch binding process section perform a saddle stitch binding process for the stack of sheets in a state where the stack of sheets is pressed by the sheet pressing unit 4.

The belt conveying section 7 includes a sheet conveying belt 7A to drive rollers to convey sheets sequentially discharged as printed materials from the multifunction peripheral 1001 through a sheet conveying path 107, and a conveying motor 7B to drive the sheet conveying belt 7A. The sheet conveying path 107 ejects the sheets successively to the sheet path on the stack plate 1. The sheets slide down successively along the stack plate 1.

The sheet position adjuster 5 includes a stacker 5A, a conveying belt 5B and a conveying motor 5C.

The stacker 5A may be a pair of hooks. The stacker 5A supports the sheets sequentially sliding down along the stack plate 1 and stacked on the stack plate 1. The stacker 5A regulates the lower end position of the stack of sheets SP. The conveying belt 5B is coupled to the stacker 5A. The conveying motor 5C drives the conveying belt 5B in order to lift up and down the stacker 5A along the sheet path. The stacker 5A aligns the lower end of the stack of sheets SP, and moves up and down along the stack plate 1 to set a center of the stack of sheets SP to a stapling position and a folding position. The center of the stack of sheets SP at the stapling position faces a staple supported by a driver unit 2A of the stapler 2. The center of the stack of sheets SP at the folding position faces a folding blade 3C of the sheet folding unit 3.

The stack plate 1 is partially opened so that the sheet folding unit 3 and the stapler 2 are exposed in the sheet path.

Figure 3:
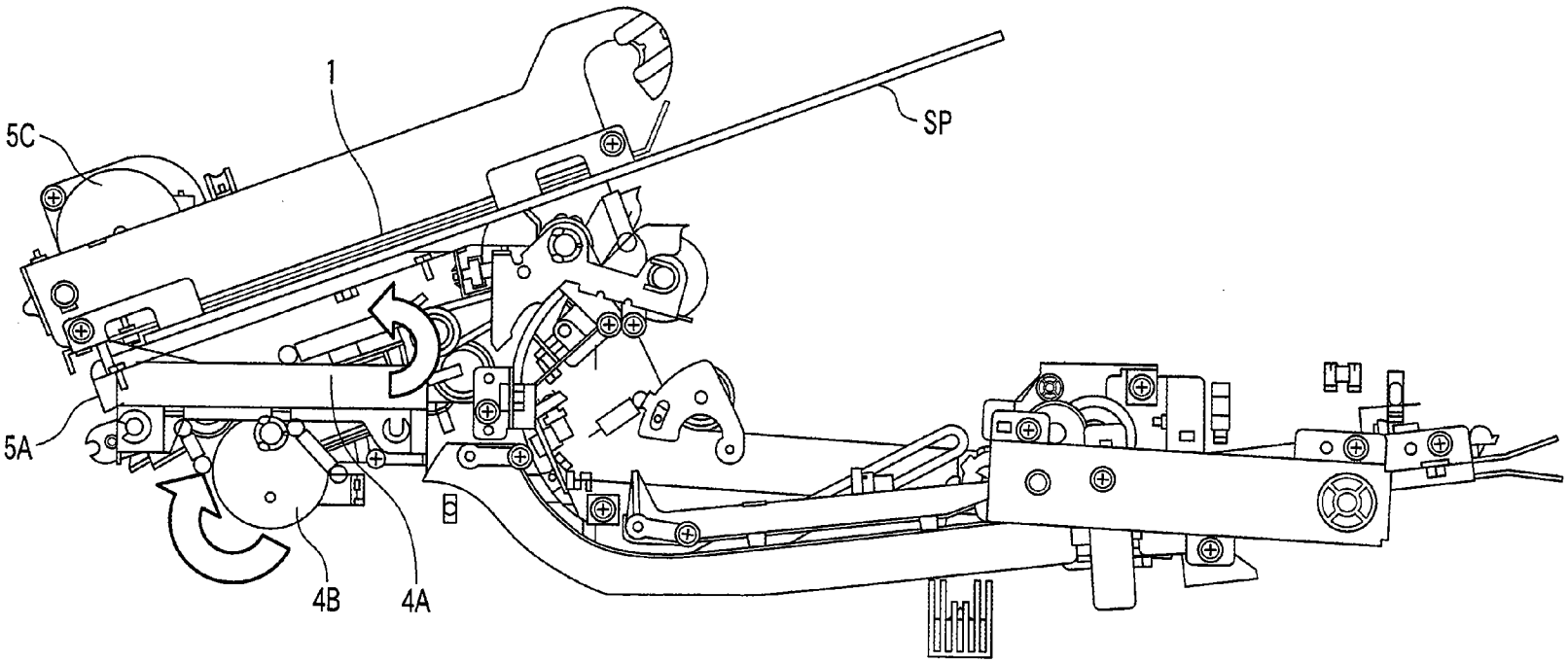
FIG. 3 is an exemplary view showing a detailed structure of a sheet pressing unit shown in FIG. 2.

FIG. 3 shows a structure of the sheet pressing unit 4 in detail. The sheet pressing unit 4 includes a flat sheet pressure plate 4A which presses the stack of sheets SP supported by the stack plate 1 and the stacker 5A toward the stack plate 1 side, an eccentric cam 4B that rotates in contact with the sheet pressure plate 4A, and a sheet pressure plate drive motor 4C that drives the eccentric cam 4B. The sheet pressure plate 4A swings with the rotation of the eccentric cam 4B about the base axis on the lower end side to temporarily press the stack of sheets SP. The sheet pressure plate 4A is at a standby position apart from the stack plate 1 at the time of sheet stacking, and is set to the sheet pressing position after the longitudinal center of the stack of sheets SP is arrived at the stapling position. Further, the sheet pressure plate 4A is again returned to the standby position after execution of stapling, and is again set to the sheet pressing position after the longitudinal center of the stack of sheets SP is arrived at the folding position. Here, the eccentric cam 4B and the sheet pressure plate drive motor 4C constitute a sheet pressure plate drive device.

Figure 4:
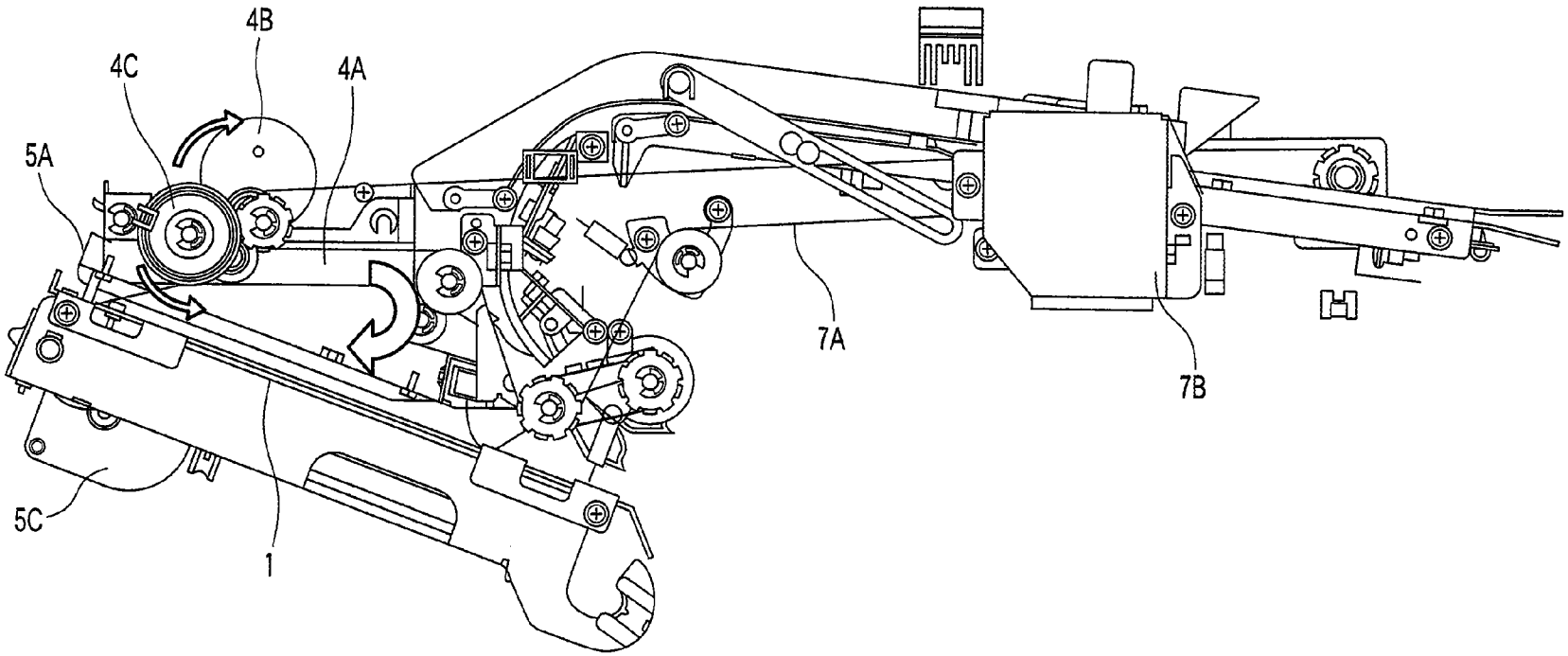
FIG. 4 is an exemplary view showing an example in which an eccentric cam shown in FIG. 3 is driven by another driving source.

Incidentally, for example, as shown in FIG. 4, the eccentric cam 4B may be driven by using the conveying motor 7B of the belt conveying section 7 and a one-way clutch mechanism 4C rotated by the conveying belt 7A. The conveying belt 7A shown in FIG. 4 rotates in a counterclockwise direction and conveys the sheet. When conveying of all sheets is completed, it becomes unnecessary to use the conveying belt 7A. Thus, the one-way clutch mechanism 4C is in an idle state when the conveying belt 7A rotates in a counterclockwise direction in FIG. 4. At this time, the sheet pressure plate 4A is kept at the standby position by the force of a spring or the like. The conveying belt 7A is rotated in the clockwise direction to set the sheet pressure plate 4A to the sheet pressing position. At this time, the one-way clutch mechanism 4C is put in a coupling state, the motive power from the drive belt 7A is transmitted to the eccentric cam 4B, and the sheet pressure plate 4A is moved to the sheet pressing position. By this, the sheet pressure plate 4A presses the stack of sheets SP supported by the stack plate 1 and the stacker 5A. In this example, the eccentric cam 4B, the conveying belt 7A, the conveying motor 7B, the one-way clutch mechanism 4C, the spring and the like serve as a drive device of the sheet pressure plate 4A.

Figure 5:
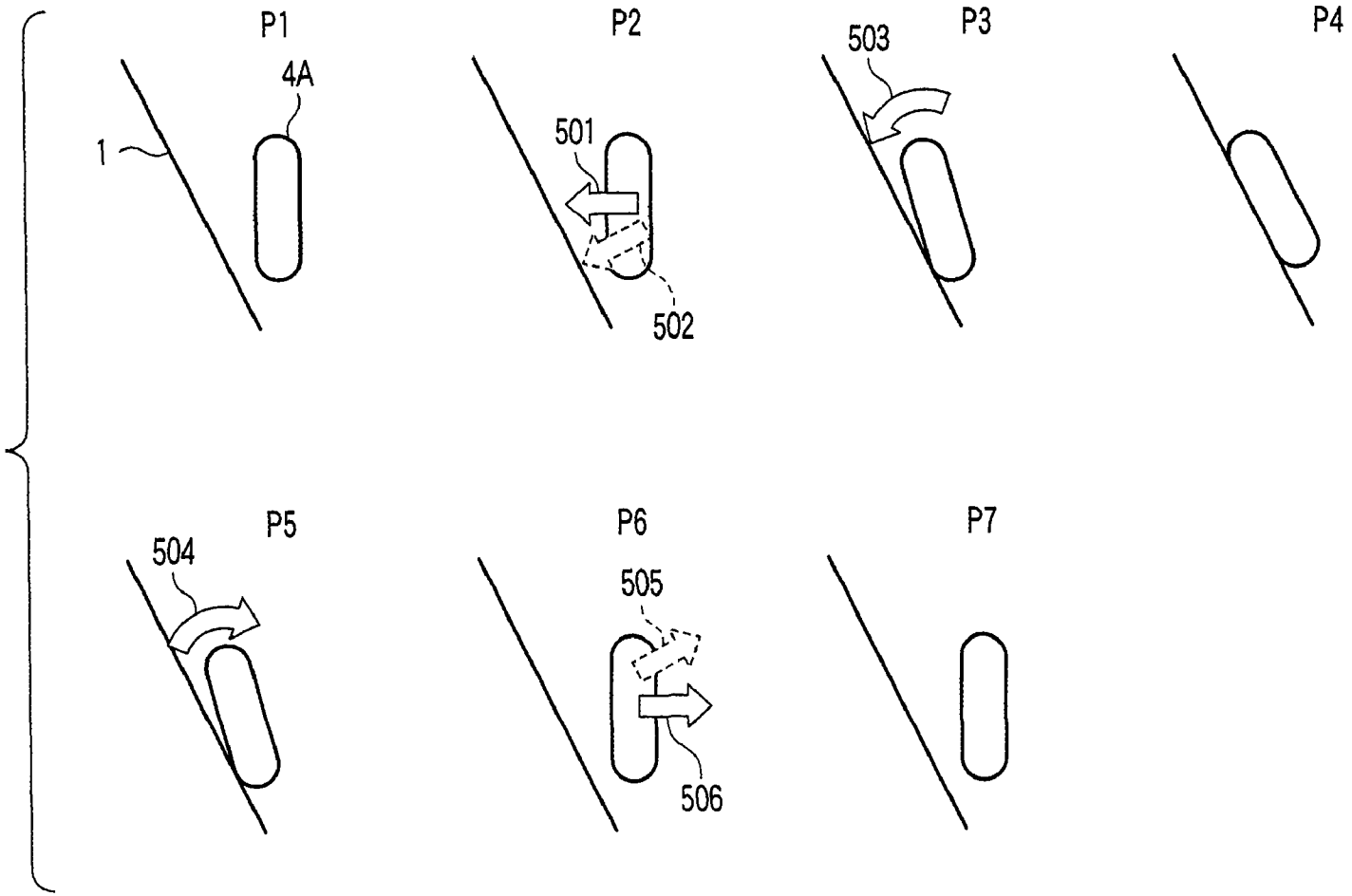
FIG. 5 is an exemplary view showing movement of the sheet pressure plate shown in FIG. 3.

The upper part of FIG. 5 shows the movement of the sheet pressure plate 4A in a case of pressing the stack of sheets SP.

A snapshot P1 indicates the sheet pressure plate 4A at the standby position. The sheet pressure plate 4A has an angle against the stack plate 1 at P1. The sheet pressure plate 4A may be in a substantially vertical state at the standby position.

A snapshot P2 indicates the sheet pressure plate 4A moving in parallel to approach the stack plate 1 from the standby position after the instant indicated by the snapshot P1. The sheet pressure plate 4A may move in a direction indicated by a broken arrow 502 perpendicular to the stack plate 1. The sheet pressure plate 4A may shift horizontally as indicated by a solid arrow 501. The sheet pressure plate 4A may shift may move in parallel posture with the posture at the standby position.

A snapshot P3 indicates the lower part of the sheet pressure plate 4A contacting with the stack plate 1 after the instant indicated by the snapshot P2. The sheet pressure plate 4A may rotate in a direction indicated by a rounded solid arrow 503. The sheet pressure plate 4A may rotate about the lower part (base axis on the lower end side, for example) so that the upper part moves toward the stack plate 1.

A snapshot P4 indicates the sheet pressure plate 4A at the sheet pressing position after the instant indicated by the snapshot P3. The upper part of the sheet pressure plate 4A arrives at the stack plate 1 to contact in substantially parallel with the stack plate 1. By this, the sheet pressure plate 4A presses the stack of sheets SP.

On the other hand, the lower part of FIG. 5 shows the movement of the sheet pressure plate 4A in a case of releasing the pressure of the stack of sheets SP.

A snapshot P5 indicates the upper part of the sheet pressure plate 4A getting away from the stack plate 1 after the instant indicated by the snapshot P4. The sheet pressure plate 4A may rotate in a direction indicated by a rounded solid arrow 504. The sheet pressure plate 4A may rotate about the lower part (base axis on the lower end side, for example) so that the upper part moves against the stack plate 1. The sheet pressure plate 4A may rotate about the lower part to take a posture in parallel with the posture at the standby position. A snapshot P6 indicates the sheet pressure plate 4A moving in parallel to separate from the stack plate 1 after the instant indicated by the snapshot P5. The sheet pressure plate 4A may move in a direction indicated by a broken arrow 505 perpendicular to the stack plate 1. The sheet pressure plate 4A may shift horizontally as indicated by a solid arrow 506. The sheet pressure plate 4A may shift may move in parallel posture with the posture at the standby position indicated by a snapshot P7. By this, the pressure of the stack of sheets SP is released.

In the case of pressing the stack of sheets SP, the lower end of the sheet pressure plate 4A first contacts the stack of sheets SP, and next, the upper end of the sheet pressure plate 4A contacts the stack of sheets SP. The sheet pressure plate 4A serves to eliminate buckling and curl of the stack of sheets SP by pressing the stack of sheets SP first from the lower end side.

Figure 6:
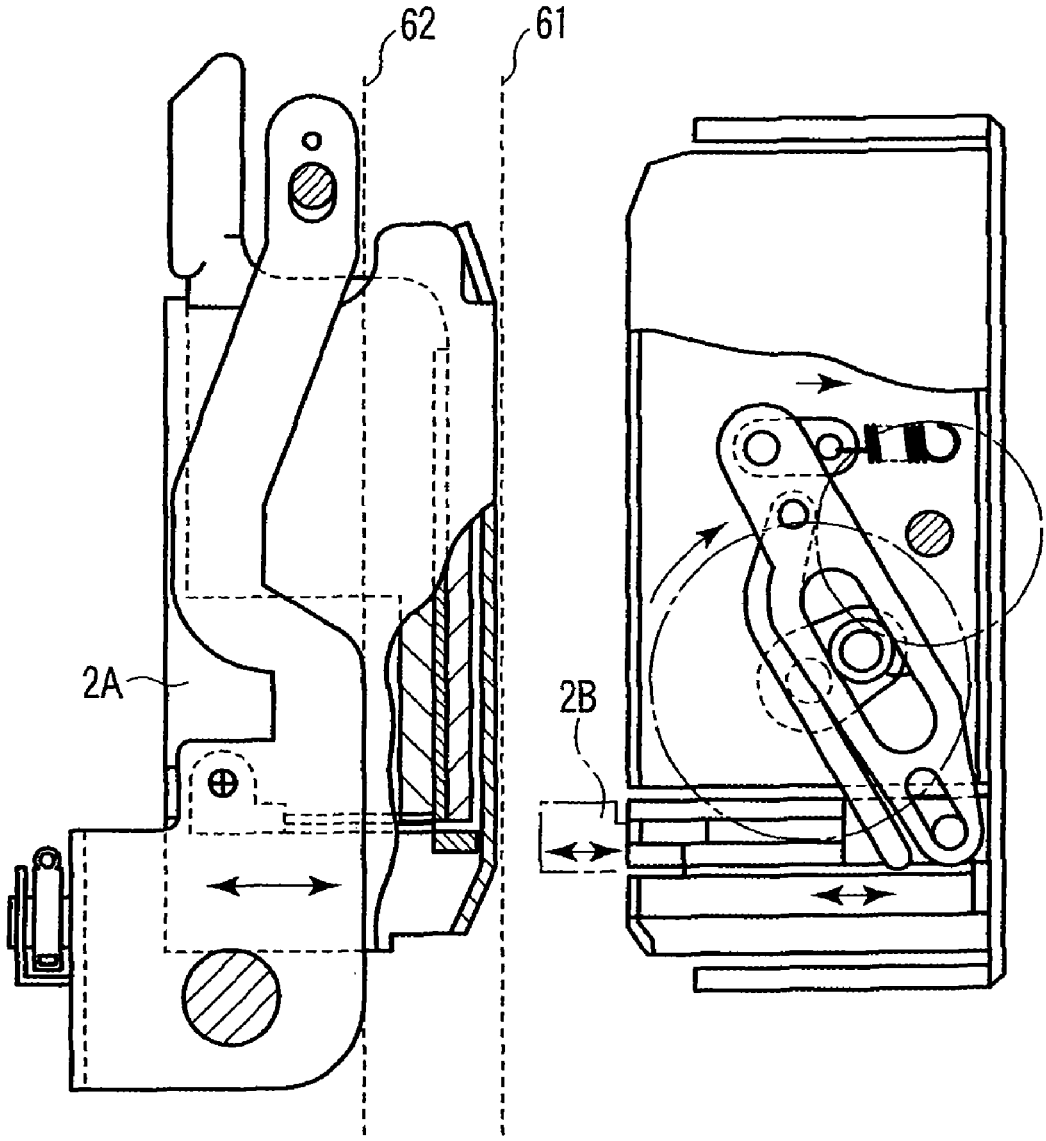
FIG. 6 is an exemplary view showing a structure of a stapler shown in FIG. 2.
Figure 7:
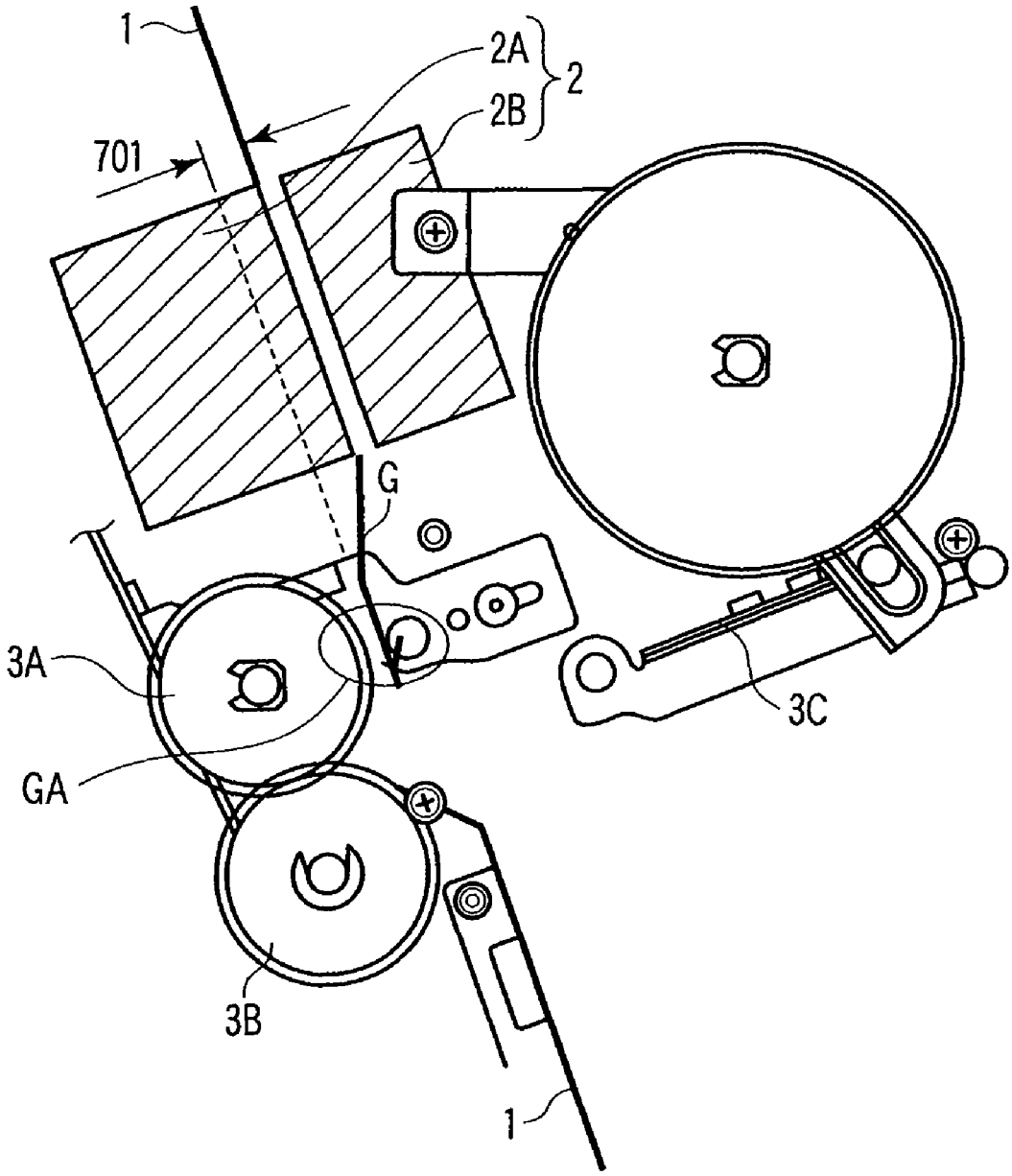
FIG. 7 is an exemplary view showing a structure of a sheet conveying guide for guiding a sheet stack to the stapler shown in FIG. 2.

FIG. 6 shows a structure of the stapler 2. The stapler 2 is, for example, of a separation type including the driver unit 2A and an anvil unit 2B. The driver unit 2A ejects a staple from a staple surface by sinking from a normal position indicated by a broken line 61 to a sinking position indicated by a broken line 62. The anvil unit 2B operates to sink the driver unit 2A. The driver unit 2A sinks together with the stack of sheets SP from the sheet loading surface 101 by the anvil unit 2B at the time of stapling, and staples the stack of sheets SP. A sheet conveying guide G is provided between the stapler 2 and the sheet folding unit 3 as shown in FIG. 7. In the operation of the anvil unit 2B for stapling, the staple surface of the driver unit 2A is sunk together with the stack of sheets SP. In view of this, the sheet conveying guide G includes a sheet loading surface offset in the sinking direction from the staple surface of the driver unit 2A, and a guide surface that extends to the staple surface of the driver unit 2A from the sheet loading surface and can be depressed. A pair of uprising members GA is provided as a part of the sheet loading surface of the sheet conveying guide G. The uprising members GA are located at a position apart from the sheet folding unit 3 by substantially the same distance as the upper end of the sheet loading surface 101 which is disposed below the sheet folding unit 3 along the sheet path. When the longitudinal center of the stack of sheets SP is moved to the folding position after stapling, the uprising members cause the stack of sheets SP to be symmetric with respect to a pair of folding rollers 3A and 3B. In this case, the height conditions of the stack of sheets SP at the upper and lower sides of the sheet folding unit 3 along the stack plate 1 are made substantially equal to each other. This results in that asymmetric distortion of the stack of sheets SP caused by a step 701 between the sheet loading surface of the sheet conveying guide G and the sheet loading surface 101 is made uniform.

Figure 8:
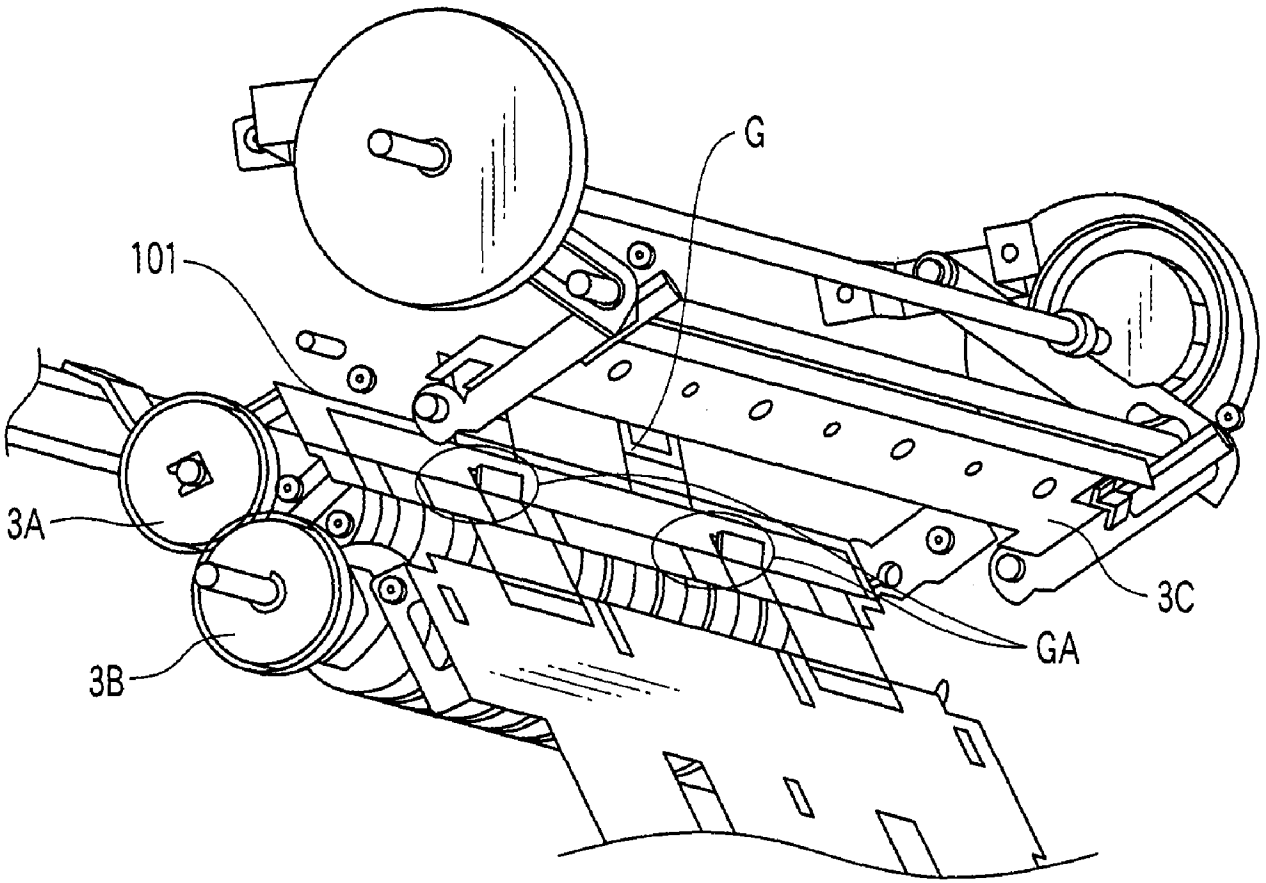
FIG. 8 is an exemplary view showing a detailed structure of a sheet folding unit shown in FIG. 2.

FIG. 8 shows a structure of the sheet folding unit in detail. The sheet folding unit 3 includes the pair of folding rollers 3A and 3B made of metal, rubber, resin or the like, and the folding blade 3C as a protruding plate that can reciprocate with respect to a nip between the folding rollers 3A and 3B. By the folding blade 3C, the longitudinal center of the stack of sheets SP is inserted into the nip between the pair of folding rollers 3A and 3B. The stack of sheets SP is folded by the rotation of these folding rollers 3A and 3B, and is discharged to the booklet discharge tray TR.

Figure 9:
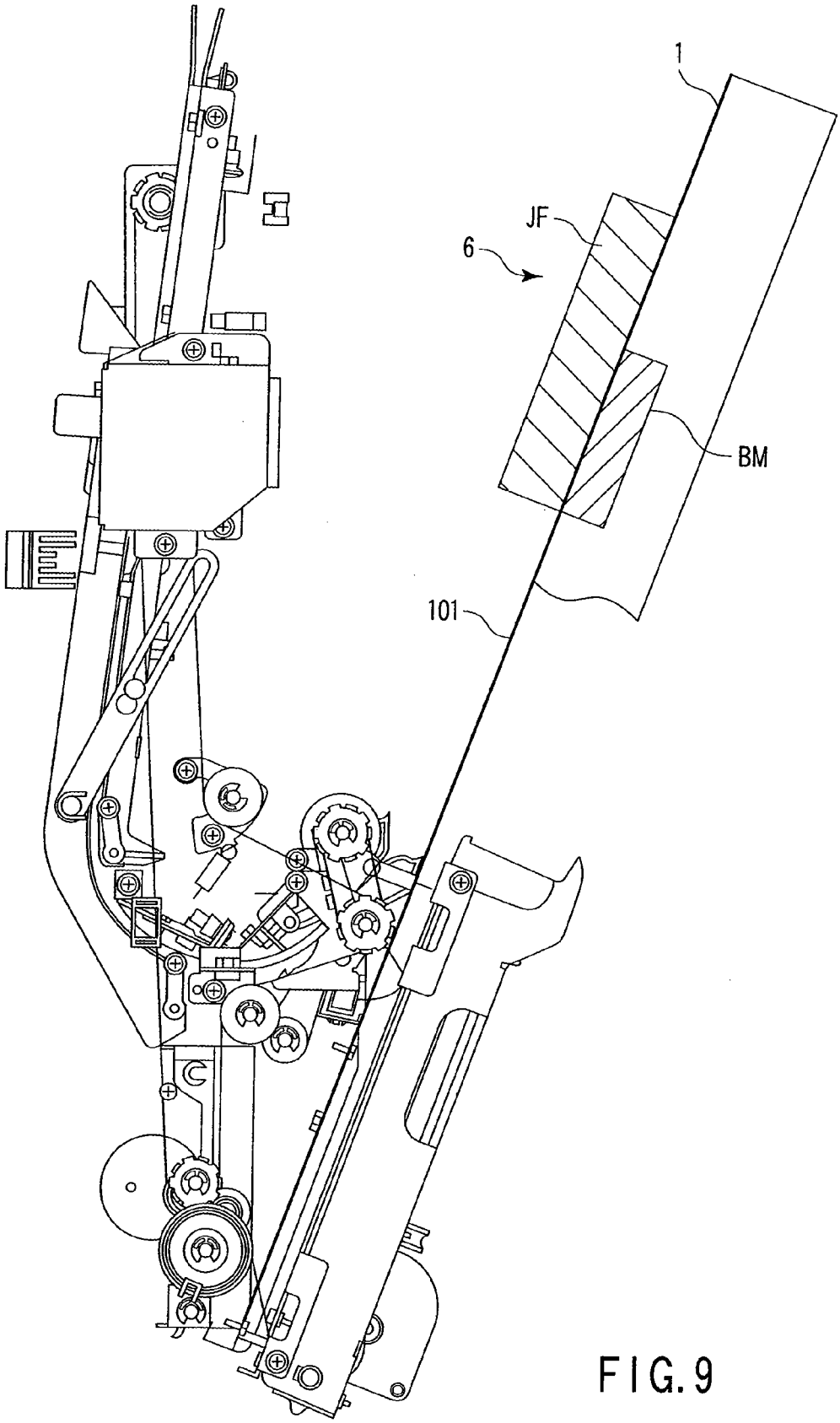
FIG. 9 is an exemplary view showing the side of a lateral alignment unit shown in FIG. 2.
Figure 10:
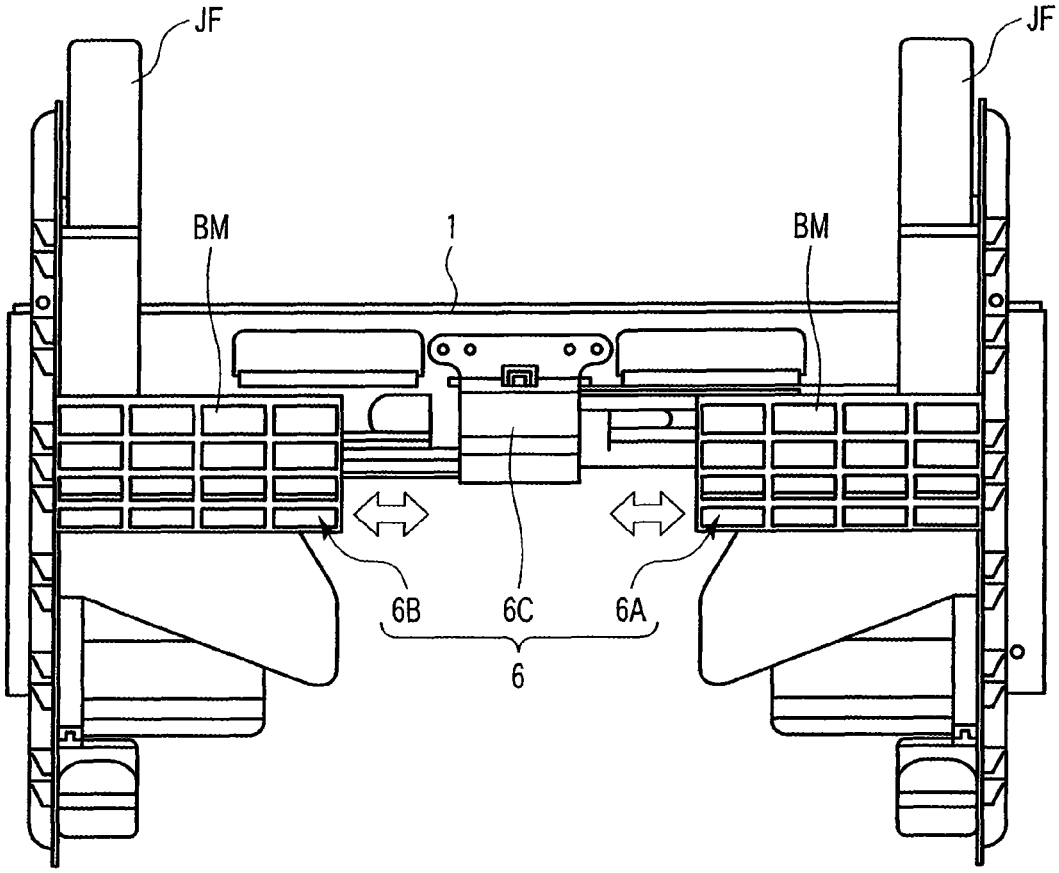
FIG. 10 is an exemplary view showing the back of the lateral alignment unit shown in FIG. 2.

FIG. 9 shows the side of the lateral alignment unit 6, and FIG. 10 shows the back of the lateral alignment unit 6. The lateral alignment unit 6 includes a pair of lateral alignment plates 6A and 6B which are disposed at the upper part of the stack plate 1 and a lateral alignment motor 6C which drives the lateral alignment plates 6A and 6B. The lateral alignment plates 6A and 6B include a pair of support base members BM disposed at the back side of the stack plate 1, and a pair of jogger fences JF coupled to both ends of the support base members through slits provided in the stack plate 1. The lateral alignment plates 6A and 6B are driven by the lateral alignment motor 6C when the longitudinal center of the stack of sheets SP is set to the stapling position or the folding position. The lateral alignment plates 6A and 6B perform a lateral aligning operation of moving in the width direction of the stack of sheets SP and temporarily pinching the SP so that both side ends of the stack of sheets SP are aligned with the jogger fences JF.

Figure 11:
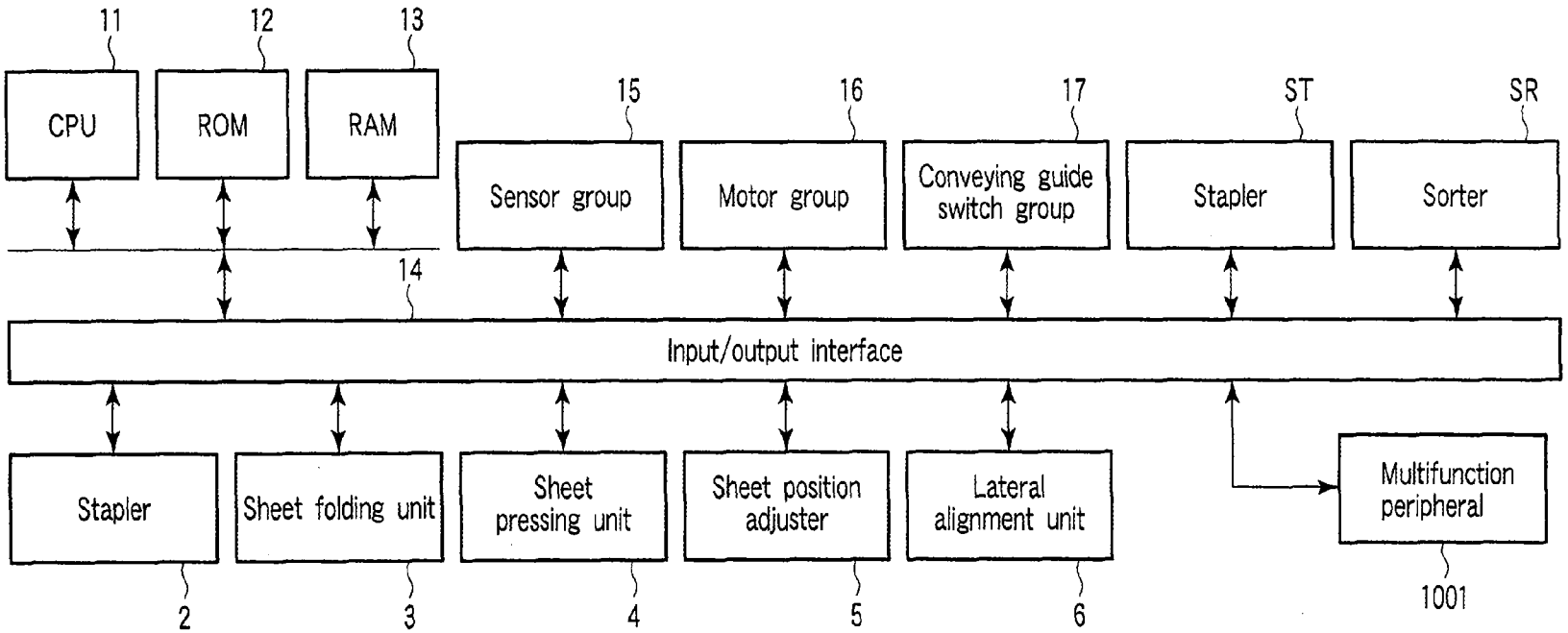
FIG. 11 is an exemplary view schematically showing a control circuit of the sheet post-process apparatus shown in FIG. 2

FIG. 11 schematically shows a control circuit of the sheet post-process apparatus. The control circuit includes a CPU 11 which controls the operation of the whole apparatus, a ROM 12 which holds a control program of the CPU 11, initial data and the like, a RAM 13 which temporarily stores data input to and output from the CPU 11, and an input and output interface 14 which inputs and outputs various data between the CPU 11 and peripheral circuits, and these components are interconnected by a bus. The stapler 2, the sheet folding unit 3, the sheet pressing unit 4, the sheet position adjuster 5, the lateral alignment unit 6, a sensor group 15, a motor group 16, and a conveying guide switch group 17 are connected to the input and output interface 14 as the peripheral circuits. The input and output interface 14 is connected also to the multifunction peripheral 1001 to acquire size data, sheet type data and print number data of sheets output as printed materials, a bookbinding command, and the like. The sensor group 15 includes, for example, a sensor which detects that the longitudinal center of the stack of sheets SP is set to the stapling position, a sensor which detects that the longitudinal center of the stack of sheets SP is set to the folding position, and a sensor which detects a sheet passing through the belt conveying section 7. The motor group 16 includes a conveying motor for the sheet conveying mechanism DS, a drive motor for the sorter SR, a drive motor for the stapler ST, a conveying motor 7B for the belt conveying section 7, a conveying motor 5C for the sheet position adjuster 5, a drive motor for the sheet pressing unit 4, a drive motor for the lateral alignment plates 6A and 6B of the lateral alignment unit 6, and the like. The conveying guide switch group 17 includes, for example, branch switches for the sheet conveying mechanism DS.

Figure 12:
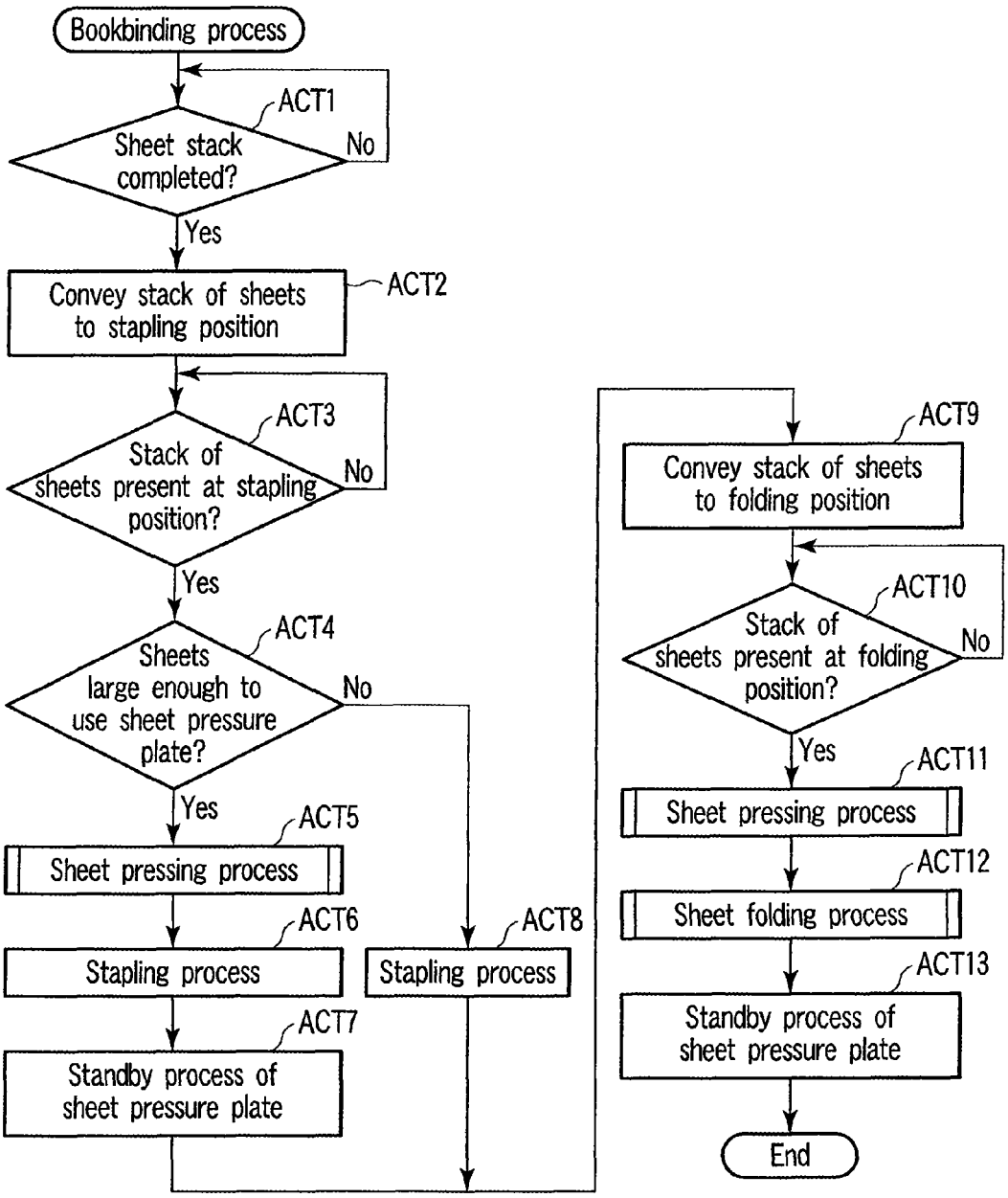
FIG. 12 is a flowchart showing a bookbinding process performed by the control circuit shown in FIG. 11.

FIG. 12 shows a bookbinding process performed by the control circuit shown in FIG. 11. The bookbinding process is started in response to a bookbinding command from the multifunction peripheral 1001. When the bookbinding process is started, it is repeatedly checked at Act 1 whether sheet stacking is completed. When the completion of the sheet stacking is detected from such a fact that the number of sheets ejected to the sheet path by the belt conveying section 7 reaches the number of sheets output from the multifunction peripheral 1001, at Act 2, the stack of sheets SP is conveyed to the stapling position. Specifically, the sheet position adjuster 5 is driven to lift up the lower end reference plate 5. At Act 3, it is repeatedly checked whether (substantially the longitudinal center of) the stack of sheets SP is present at the stapling position. This is confirmed in a manner that the stacker 5A is detected, for example, by a sensor disposed according to the sheet size. Upon confirmation, it is checked at Act 4 whether the stack of sheets SP is of large-sized sheets which are large enough to use the sheet pressure plate 4A. When it is confirmed from the size data that the stack of sheets SP is of the large-sized sheets, a sheet pressing process is performed at Act 5. In this sheet pressing process, the sheet pressing unit 4 is driven to obtain the movement of the sheet pressure plate 4A shown in the upper part of FIG. 5. When the stack of sheets SP is pressed by the sheet pressure plate 4A, a stapling process is performed by driving the stapler 2 at Act 6. After the stapling process, a standby process of the sheet pressure plate 4A is performed at Act 7. In this standby process, the sheet pressing unit 4 is driven to obtain the movement of the sheet pressure plate 4A shown in the lower part of FIG. 5. The sheet pressure plate drive device moves the sheet pressure plate 4A from the sheet pressing position to the standby position in a shorter time than a time of the movement from the standby position to the sheet pressing position of Act 5. On the other hand, if the size data indicates that a size of stack of sheets SP is short not enough to use the sheet pressure plate 4A at Act 4, a stapling process is performed at Act 8 without pressing the stack of sheets SP by the sheet pressing unit 4 and returning the sheet pressure plate 4A to the standby position. This stapling process is identical to the stapling process performed at Act 6.

After Act 7 or Act 8, the stack of sheets SP is conveyed to the folding position at Act 9. Specifically, the sheet position adjuster 5 is driven to lift down the stacker 5A. Act 10, it is repeatedly checked whether (longitudinal center of) the stack of sheets SP is present at the folding position. This is confirmed in a manner that the stacker 5A is detected, for example, by a sensor disposed according to the sheet size. Upon confirmation, a sheet pressing process is performed at Act 11. In this sheet pressing process, the sheet pressing unit 4 is driven to obtain the movement of the sheet pressure plate 4A shown in the upper part of FIG. 5. When the sheet pressure plate 4A presses the stack of sheets SP, a sheet folding process is performed at Act 12 by driving the sheet folding unit 3. The stack of sheets SP is put in a state of being folded by the sheet folding process and is discharged to the booklet discharge tray TR. After the sheet folding process, a standby process of the sheet pressure plate 4A is performed at Act 13. At this standby process, the sheet pressing unit 4 is driven to obtain the movement of the sheet pressure plate 4A shown in the lower part of FIG. 5. The sheet pressure plate drive device moves the sheet pressure plate 4A from the sheet pressing position to the standby position in a shorter time than that of the movement from the standby position to the sheet pressing position at Act 12. After execution of Act 13, the bookbinding process is ended.

Incidentally, in the above-mentioned bookbinding process, the sheet size in which the sheet pressure plate 4A can be used may have such a condition that when the stack of sheets SP is set to the stapling position, the lower end of the stack of sheets SP is below the upper end of the sheet pressure plate 4A. When the sheet folding apparatus handles only sheets having such a size that the sheet pressure plate 4A can be used at the stapling position, above mentioned Act 4 and Act 8 are omitted. Further, when the sheet folding apparatus handles only sheets having such a size that the sheet pressure plate 4A can not be used at the stapling position, above mentioned Act 4 to Act 7 are omitted.

Figure 13:
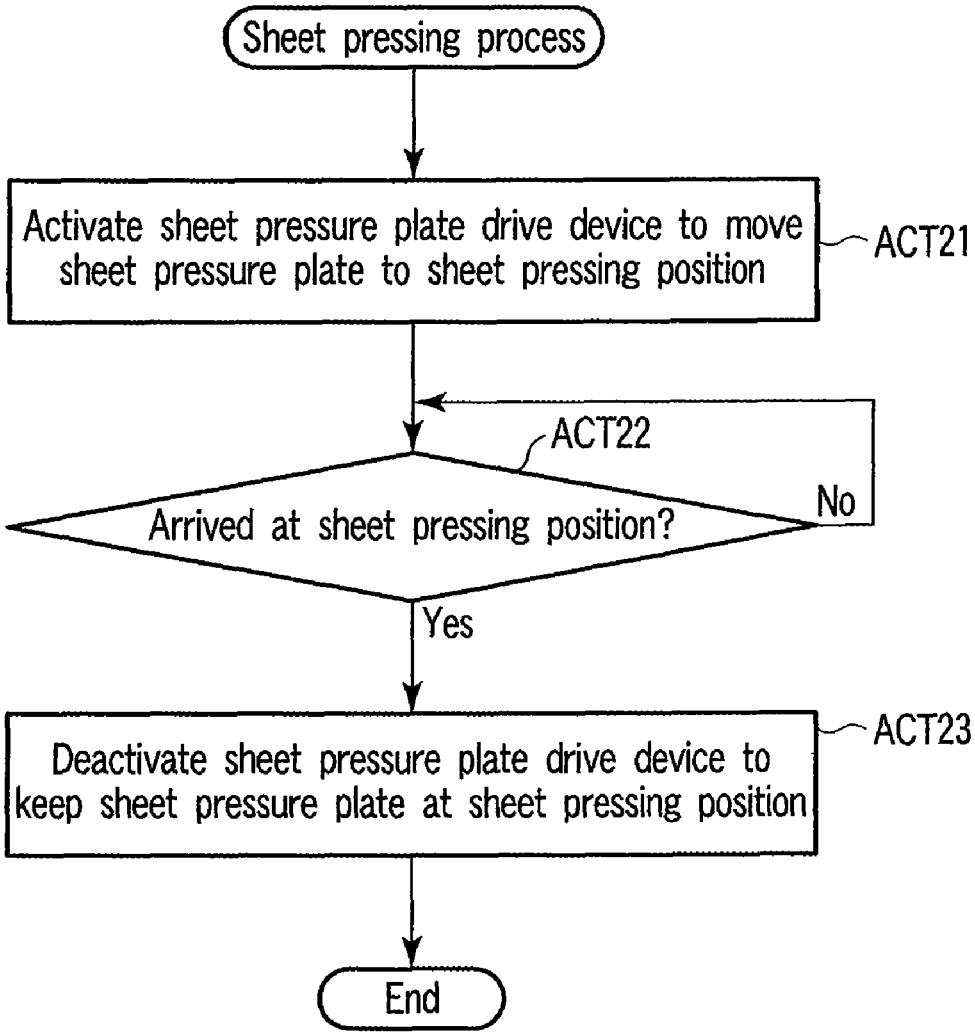
FIG. 13 is a flowchart showing an example of a sheet pressing process shown in FIG. 12.

FIG. 13 shows an example of a process performed at Act 5 and Act 11 shown in FIG. 12. When the sheet pressing process is started, the sheet pressure plate drive device is activated at Act 21 to move the sheet pressure plate 4A to the sheet pressing position. At Act 22, it is repeatedly checked whether the sheet pressure plate 4A is arrived at the sheet pressing position. When the arrival at the sheet pressing position is detected, the sheet pressure plate drive device is deactivated at Act 23 to keep the sheet pressure plate 4A at the sheet pressing position. The process is ended with the execution of Act 23.

Figure 14:
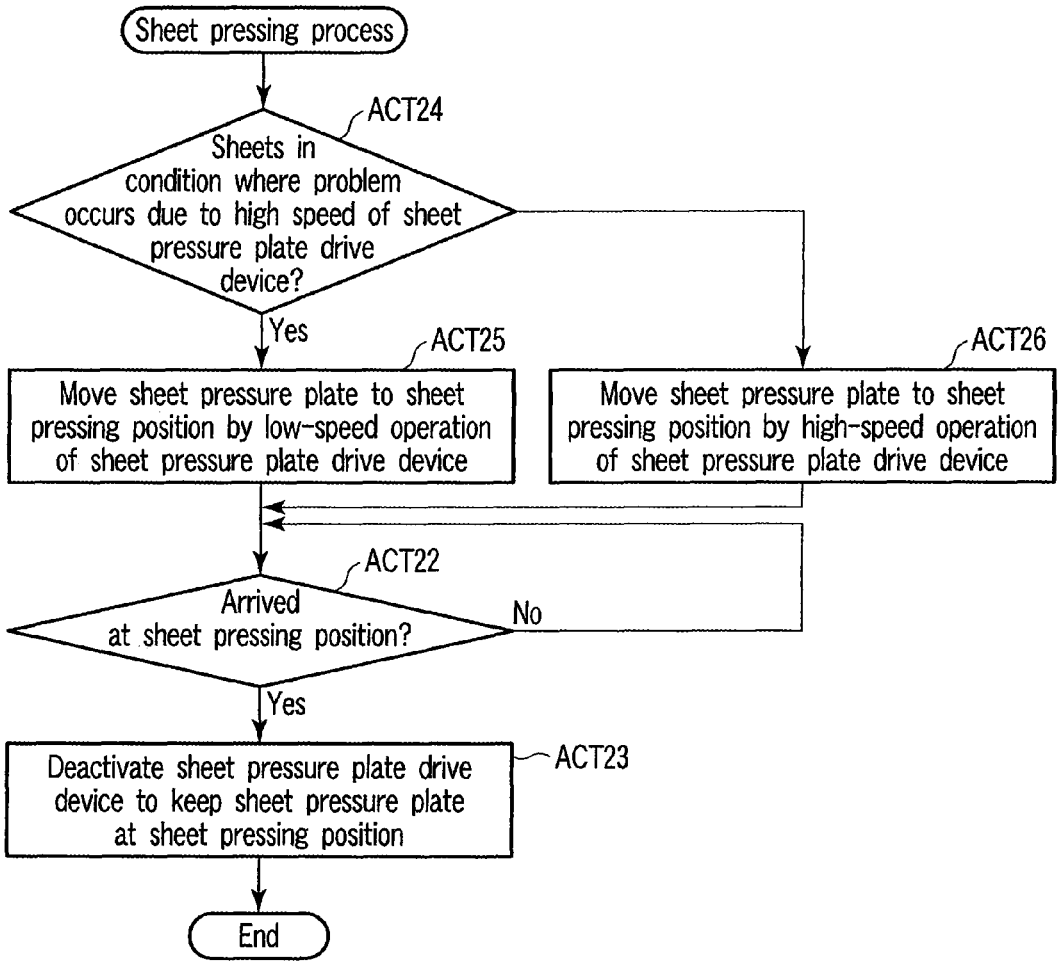
FIG. 14 is a flowchart showing a modification of the sheet pressing process shown in FIG. 13.

FIG. 14 shows a modification of the process shown in FIG. 13. In this modification, Act 21 shown in FIG. 13 is replaced by Act 24 to Act 26. When sheet pressing process is started, it is checked at Act 24 whether sheets are in condition where a problem occurs due to high speed of the sheet pressure plate drive device. In the sheet condition such as a thin type in which curl is liable to occur, the high speed becomes a cause of occurrence of a sheet jam. Further, in the sheet condition such as a large number of sheets to be stapled, the high speed becomes a cause of occurrence of defective stapling. When one of the sheet conditions is detected, the sheet pressure plate 4A is moved at Act 25 to the sheet pressing position by the low-speed operation of the sheet pressure plate drive device. In this low-speed operation, a portion where a large torque is obtainable in the drive device such as a motor is used for sheet pressing. Incidentally, at this low-speed operation, the sheet pressure plate 4A is driven at low speed only when the sheet pressure plate drive device starts to operate, and the moving speed of the sheet pressure plate 4A may be gradually accelerated.

Further, when any of the above-mentioned sheet conditions is not detected, the sheet pressure plate 4A is moved at Act 26 to the sheet pressing position in a normal manner by the high-speed operation of the sheet pressure plate drive device. At Act 22 subsequent to Act 25 or Act 26, it is repeatedly checked whether the sheet pressure plate 4A is arrived at the sheet pressing position. When the arrival at the sheet pressing position is detected, the sheet pressure plate drive device is deactivated at Act 23 to keep the sheet pressure plate 4A at the sheet pressing position. The process is ended with the execution of Act 23.

Figure 15:
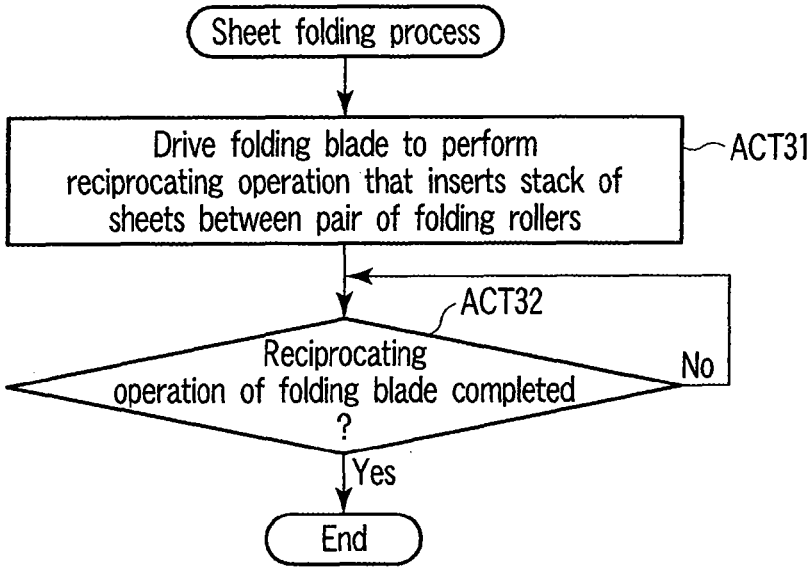
FIG. 15 is a flowchart showing an example of a sheet folding process shown in FIG. 12.

FIG. 15 shows an example of the sheet folding process performed at Act 12 shown in FIG. 12. When this sheet folding process is started, at Act 31, the folding blade 3C starts reciprocating to insert the stack of sheets SP between the pair of folding rollers 3A and 3B. It is repeatedly checked at Act 32 whether the folding blade 3C finishes reciprocating. When the folding blade 3C finishes reciprocating, the sheet folding process is ended.

Figure 16:
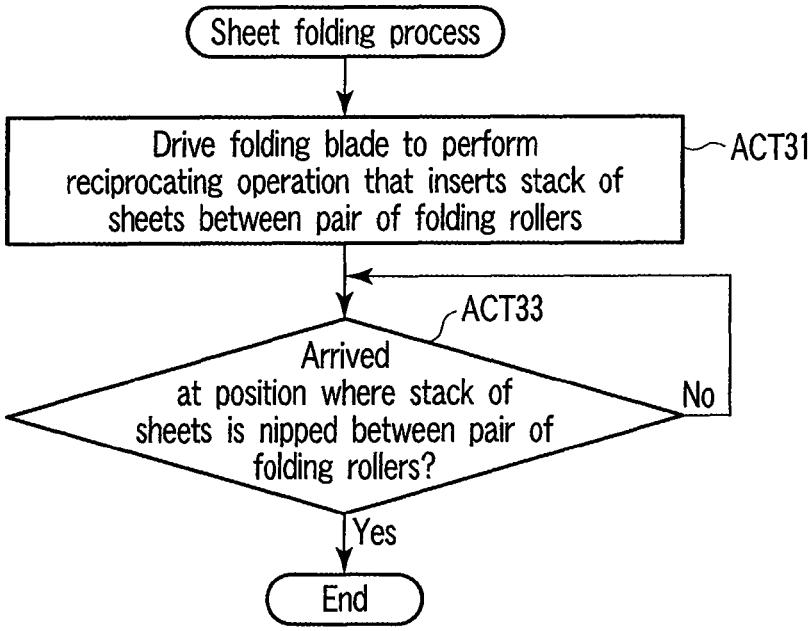
FIG. 16 is a flowchart showing a modification of the sheet folding process shown in FIG. 15.

FIG. 16 shows a modification of the sheet folding process shown in FIG. 15. In this modification, Act 32 shown in FIG. 15 is replaced by Act 33. When this sheet folding process is started, at Act 31, the folding blade 3C is driven to perform the reciprocating operation that inserts the stack of sheets SP between the pair of folding rollers 3A and 3B. At Act 33, it is repeatedly checked whether the stack of sheets SP is arrive at a position where it is nipped between the pair of folding rollers 3A and 3B. When this arrival is detected, the sheet folding process is ended.

Figure 17:
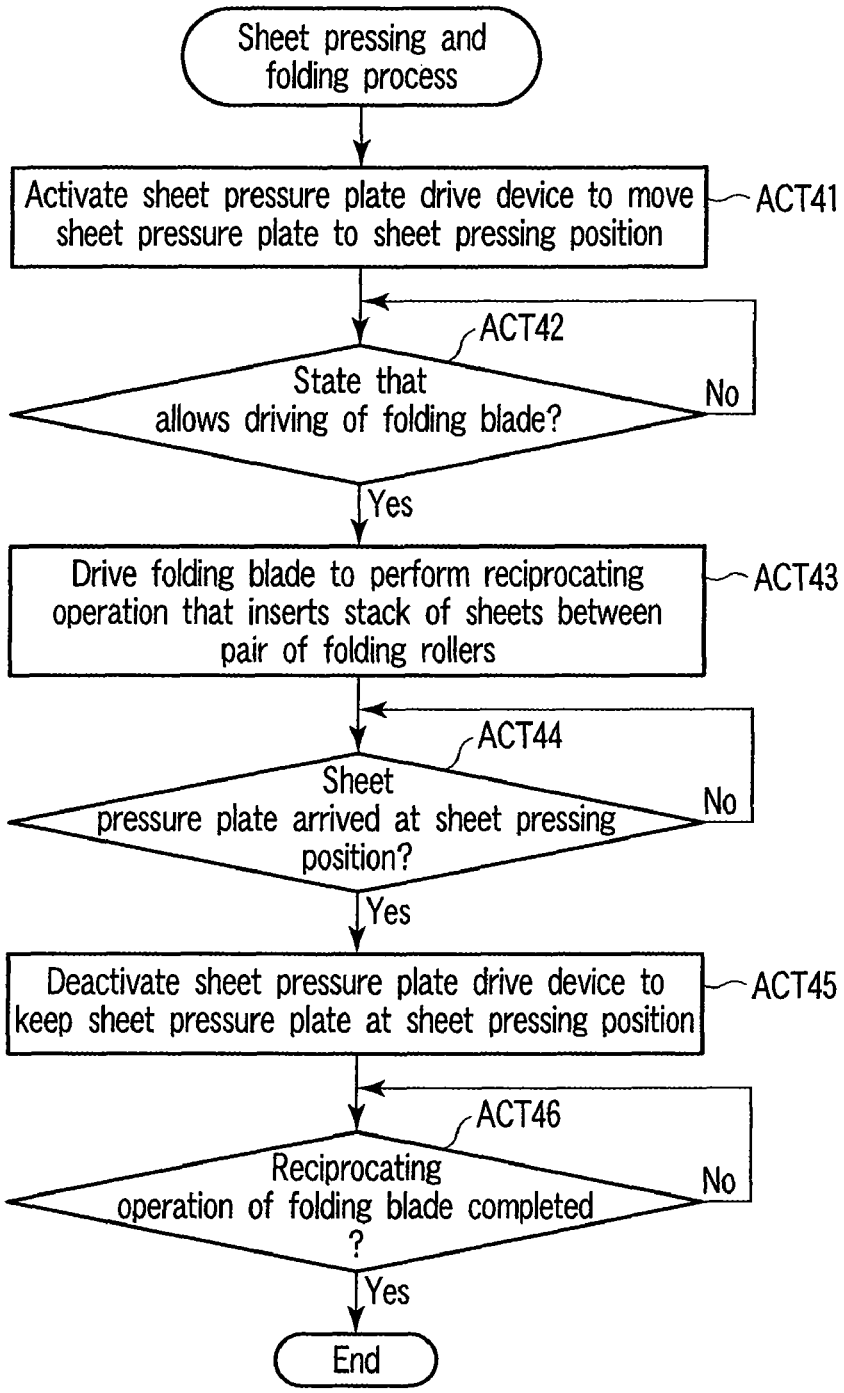
FIG. 17 is a flowchart showing a modification in which the sheet pressing process and the sheet folding process shown in FIG. 12 are made independent as a sheet pressing and folding process.

FIG. 17 shows a modification in which Act 11 and Act 12 shown in FIG. 12 are made independent as a sheet pressing and folding process. The sheet pressing and folding process is used to shorten the processing time by driving the folding blade 3C before the sheet pressure plate 4A is arrived at the sheet pressing position to temporarily operate the sheet pressure plate 4A and the folding blade 3C in parallel. When the sheet pressing and folding process is started, the sheet pressure plate drive device is activated at Act 41 to move the sheet pressure plate 4A moved to the sheet pressing position. At act 42, it is repeatedly checked whether a state that allows driving of the folding blade 3C is established. The state that arrows the driving of the folding blade 3C is regarded as a state in which the sheet pressure plate 4A can be arrived at the sheet pressing position before the folding blade 3C contacts the stack of sheets SP. When the state that arrows driving of the folding blade 3C is detected, at Act 43, the folding blade 3C is driven to perform the reciprocating operation of inserting the stack of sheets SP between the pair of folding rollers 3A and 3B. At Act 44, it is repeatedly checked whether the sheet pressure plate 4A is arrived at the sheet pressing position. When the arrival at the sheet pressing position is detected, at Act 45, the sheet pressure plate drive device is deactivated to keep the sheet pressure plate 4A at the sheet pressing position. At Act 46, it is repeatedly checked whether the reciprocating operation of the folding blade 3C is completed. When the completion of the reciprocating operation is detected, the sheet pressing and folding process is ended.

Figure 18:
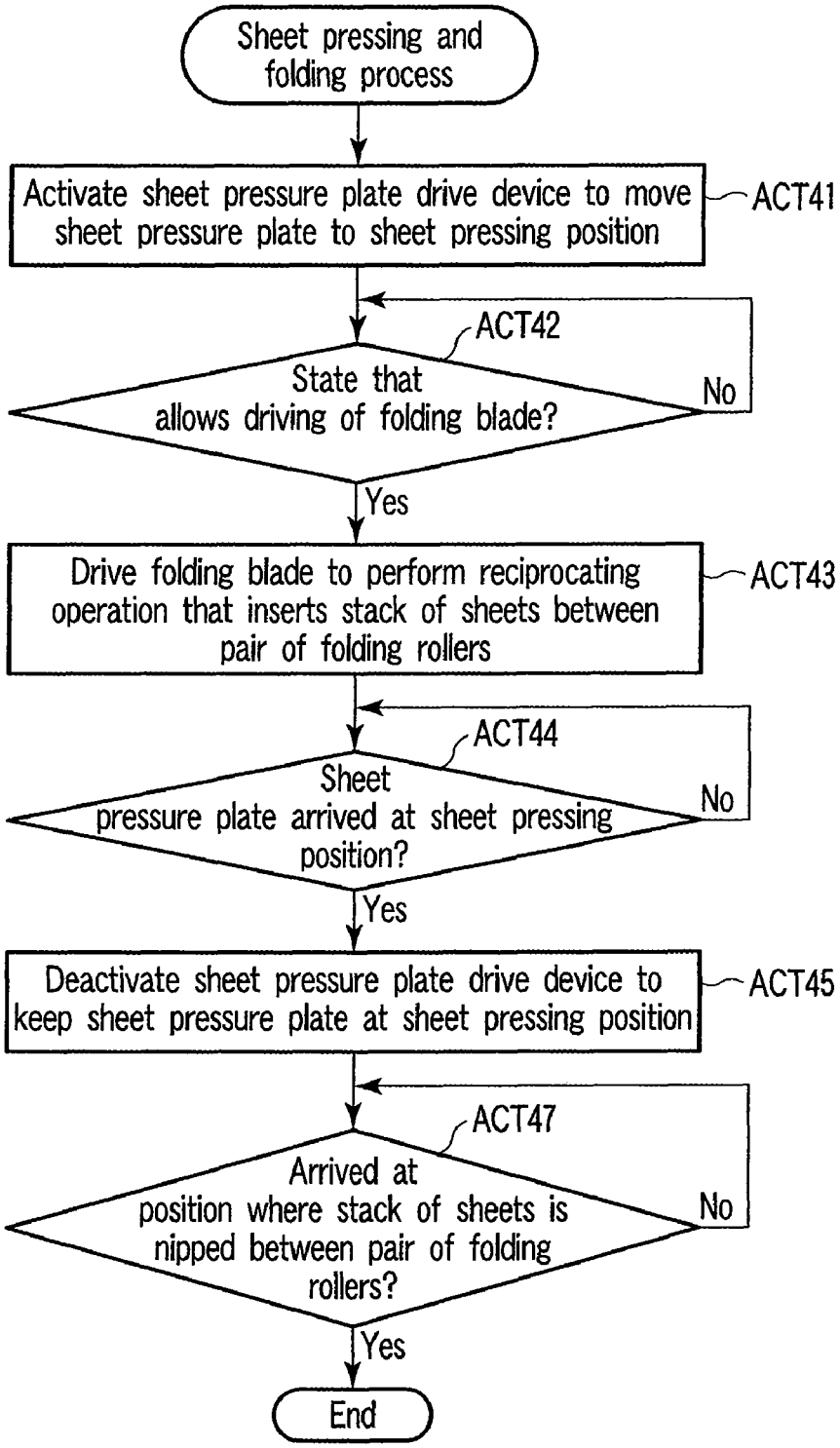
FIG. 18 is a flowchart showing a modification of the sheet pressing and folding process shown in FIG. 17.

FIG. 18 shows a modification of the sheet pressing and folding process shown in FIG. 17. In this modification, Act 46 shown in FIG. 17 is replaced by Act 47. That is, at Act 47, it is repeatedly checked whether the stack of sheets SP is arrived at a position where the stack of sheets SP is nipped between the pair of folding rollers 3A and 3B. When this arrival is detected, the sheet pressing and folding process is ended.

Incidentally, the lateral alignment operation of the lateral alignment plates 6A and 6B can be performed by driving the lateral alignment motor 6C to align the side ends of the stack of sheets SP before the stapling and before the sheet folding. However, in this case, it is preferable to optimize the drive start timing of the sheet pressure plate drive motor 4C of the sheet pressure plate 4A with respect to the lateral alignment motor 6C.

Figure 19:
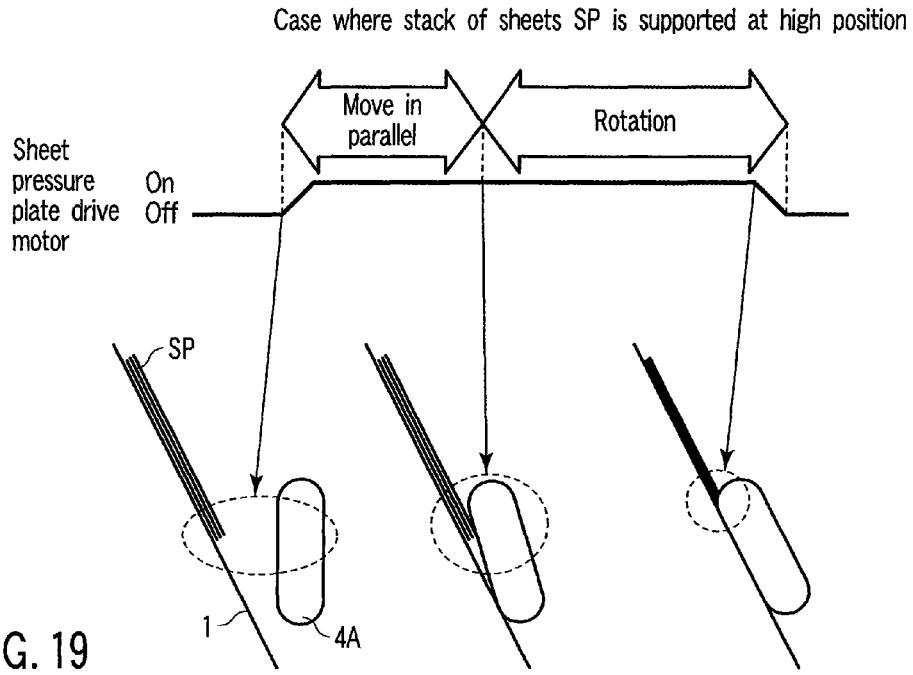
FIG. 19 is an exemplary view showing a positional relationship between the sheet pressure plate and a sheet stack obtained by the sheet pressing process for stapling shown in FIG. 12.
Figure 20:
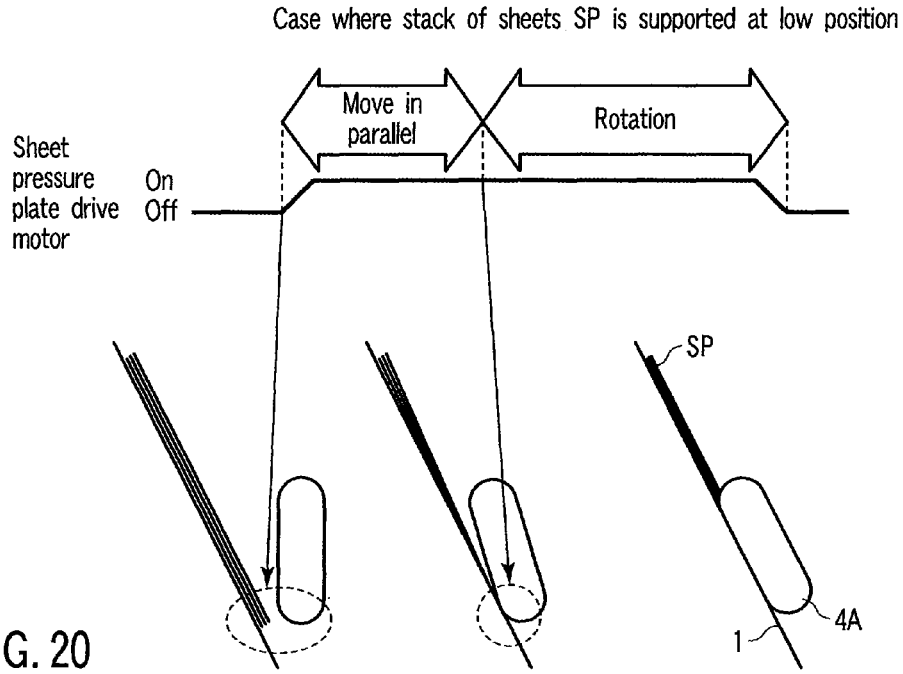
FIG. 20 is an exemplary view showing a positional relationship between the sheet pressure plate and the sheet stack obtained by the sheet pressing process for sheet folding shown in FIG. 12.

FIG. 19 shows a positional relationship between the sheet pressure plate 4A and the stack of sheets SP obtained by pressing the stack of sheets SP for stapling, and FIG. 20 shows a positional relationship between the sheet pressure plate 4A and the stack of sheets SP obtained by pressing the stack of sheets SP for sheet folding. Here, the stack of sheets SP has a sheet size which is determined to be pressed by the sheet pressure plate 4A at each of the stapling position and the sheet folding position.

When the stack of sheets SP is located at the stapling position shown in FIG. 19, the sheet pressure plate 4A does not contact the stack of sheets SP by merely shifting in parallel. When reaching the sheet pressing position, the sheet pressure plate 4A contacts the stack of sheets SP. On the other hand, when the stack of sheets SP is located at the sheet folding position shown in FIG. 20, the sheet pressure plate 4A contacts the stack of sheets SP by merely shifting in parallel. Thus, after the sheet pressure plate drive motor 4C of the sheet pressure plate 4A is started, a difference occurs in the time required for the sheet pressure plate 4A to actually contact the stack of sheets SP.

Figure 21:
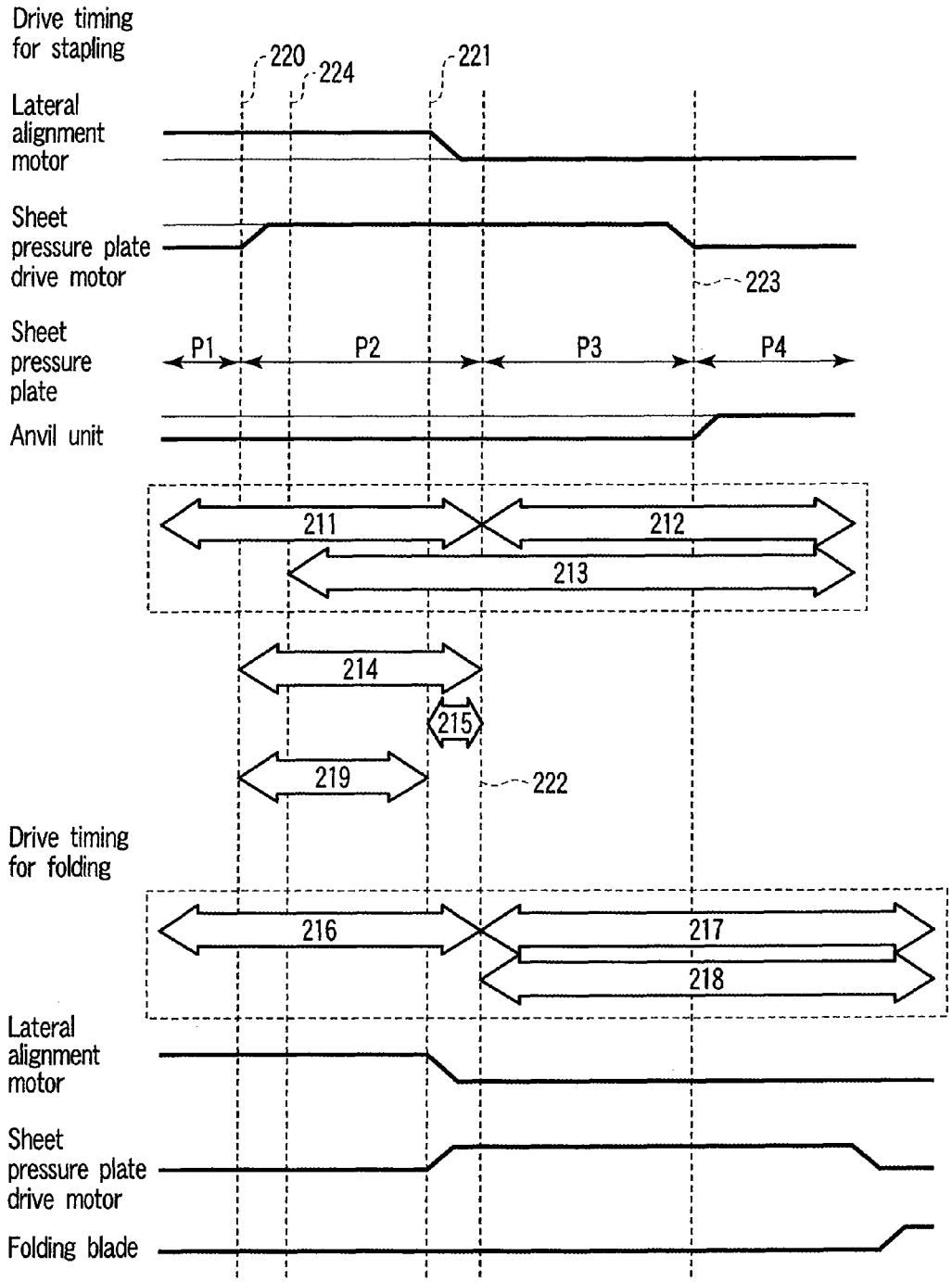
FIG. 21 is an exemplary timing chart of a sheet pressure plate drive motor and a lateral alignment motor.

FIG. 21 shows a timing chart of the sheet pressure plate drive motor 4C and the lateral alignment motor 6C.

For stapling, the lateral alignment motor 6C drives the lateral alignment plates 6A and 6B. The lateral alignment motor 6C starts to slow at an instant indicated by a broken line 221. The lateral alignment motor 6C stops after a predetermined time elapses from an instant indicated by a broken line 221.

The sheet pressure plate drive motor 4C starts and accelerates to drive the sheet pressure plate 4A from an instant indicated by a broken line 220. The sheet pressure plate drive motor 4C drives beyond the instant indicated by the broken lines 224, 221 and 222. The sheet pressure plate drive motor 4C stops at an instant indicated by a broken line 223 after a period for slowing.

The sheet pressure plate 4A may be at the standby position indicated as P1 in FIG. 5 before the sheet pressure plate drive motor 4C starts to drive at the instant indicated by the broken line 220.

The sheet pressure plate 4A may move in parallel to approach the stack plate 1 from the standby position after the sheet pressure plate drive motor 4C starts to drive. The sheet pressure plate 4A may move beyond the position indicated as P2 in FIG. 5.

The lower part of the sheet pressure plate 4A may contact with the stack plate 1 after an instant indicated by a broken line 224, but the sheet pressure plate 4A may still not contact with the stack of sheet until an instant indicated by a broken line 222. The sheet pressure plate 4A may rotate beyond the position indicated as P3 in FIG. 5.

The sheet pressure plate 4A may contact with the stack of sheet after the instant indicated by a broken line 222. The sheet pressure plate 4A may be at the sheet pressing position indicated as P4 in FIG. 5 at the instant indicated by a broken line 223.

The anvil unit 2B starts to move toward the driver unit 2A at the instant indicated by a broken line 223.

The sheet pressure plate 4A does not press the stack of the sheets during a term indicated by an arrow 211. The sheet pressure plate 4A may keep off from the stack of the sheets during a term indicated by an arrow 211.

The sheet pressure plate 4A contacts with the stack plate 1 during a term indicated by an arrow 213.

The sheet pressure plate 4A press the stack of the sheets during a term indicated by an arrow 212.

On the other hand, for folding, the lateral alignment motor 6C starts to slow at an instant indicated by a broken line 221 as same as for stapling.

The sheet pressure plate drive motor 4C starts and accelerates to drive the sheet pressure plate 4A from an instant indicated by a broken line 221 at the time as same as the lateral alignment motor 6C starts to slow. The sheet pressure plate drive motor 4C drives beyond the instant indicated by the broken lines 222 and 223. The sheet pressure plate drive motor 4C stops after a period for slowing. The folding blade 3*c* starts proceeding to insert the stack of sheets between the pair of folding rollers 3A and 3B after the sheet pressure plate drive motor 4C stops.

An arrow 214 in FIG. 21 indicates a time difference between start of sheet pressure plate drive motor 4C for stapling and start of actual pressing of stack of sheets by sheet pressure plate 4A. At stapling, the sheet pressure plate drive motor 4C can start earlier than the lateral alignment motor 6C stops.

An arrow 215 in FIG. 21 indicates a time difference between start of sheet pressure plate drive motor 4C for folding and start of actual pressing of stack of sheets by sheet pressure plate 4A. At folding, there is little time in which the lateral alignment motor 6C and the sheet pressure plate drive motor 4C can drive simultaneously.

That is, the sheet pressure plate 4A starts proceeding at stapling earlier that at folding by a term indicated by a arrow 219.

Although driving of the sheet pressure plate drive motor 4C of the sheet pressure plate 4A is started almost at the same time as the stop of the lateral alignment motor 6C in pressing the stack of sheets SP for sheet folding, it is started before the stop of the lateral alignment motor 6C in pressing the stack of sheets SP for stapling. By such control, the time required for pressing the stack of sheets SP can be shortened.

Figure 22:
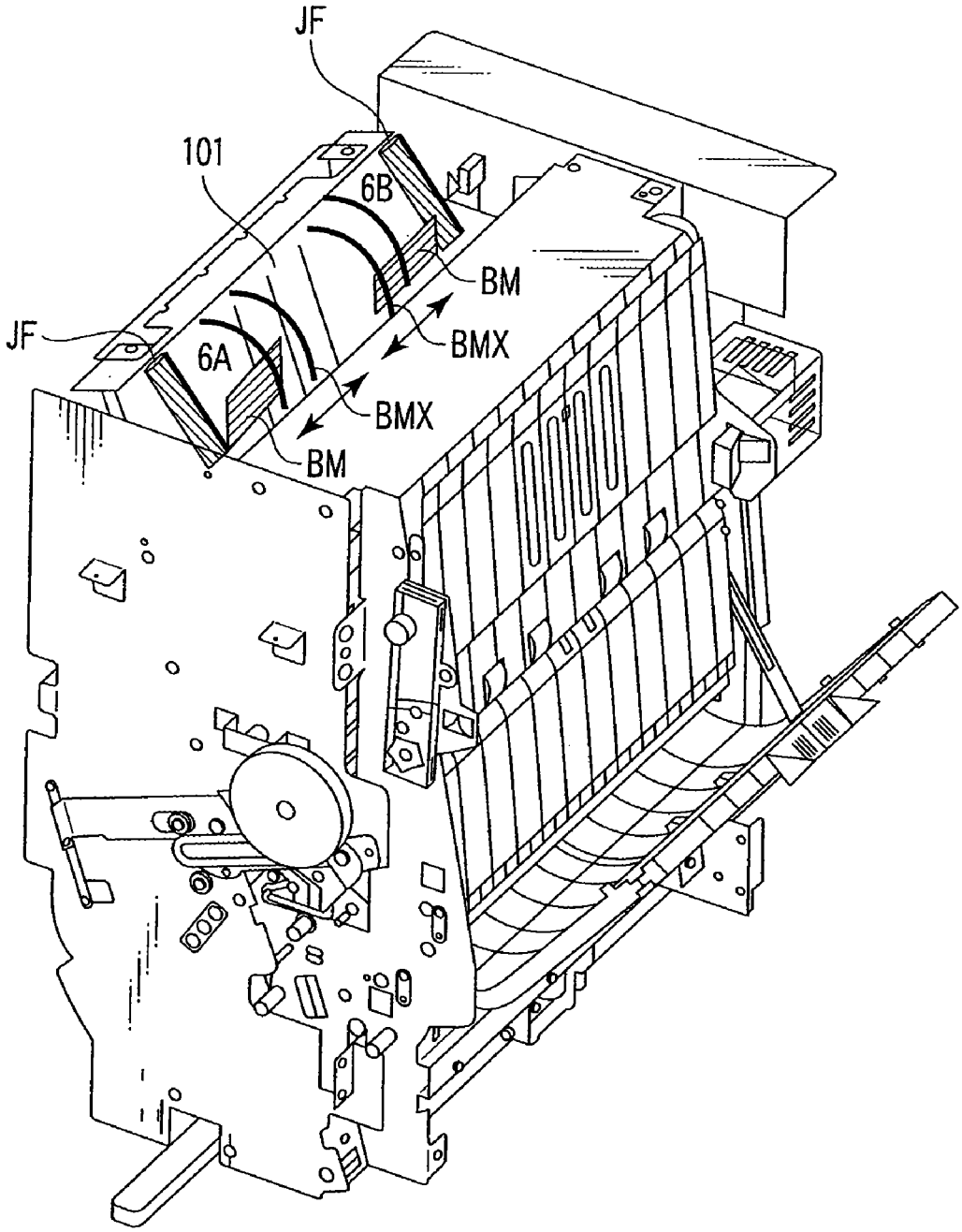
FIG. 22 is an exemplary view showing a modification of the lateral alignment unit shown in FIG. 10.

FIG. 22 shows a modification of the lateral alignment unit 6. In this modification, an arch-shaped conductive member BMX is further provided. The support base member BM of the lateral alignment plates 6A and 6B is disposed to be exposed on the sheet loading surface 101, and the arch-shaped conductive member BMX is disposed to be in parallel to the jogger fence JF and to stride the support base member BM. The arch-shaped conductive member BMX prevents the stack of sheets SP from directly contacting with the support base member BM. By this, sliding of the stack of sheets SP is improved and adhesion by static electricity can be removed.

Figure 23:
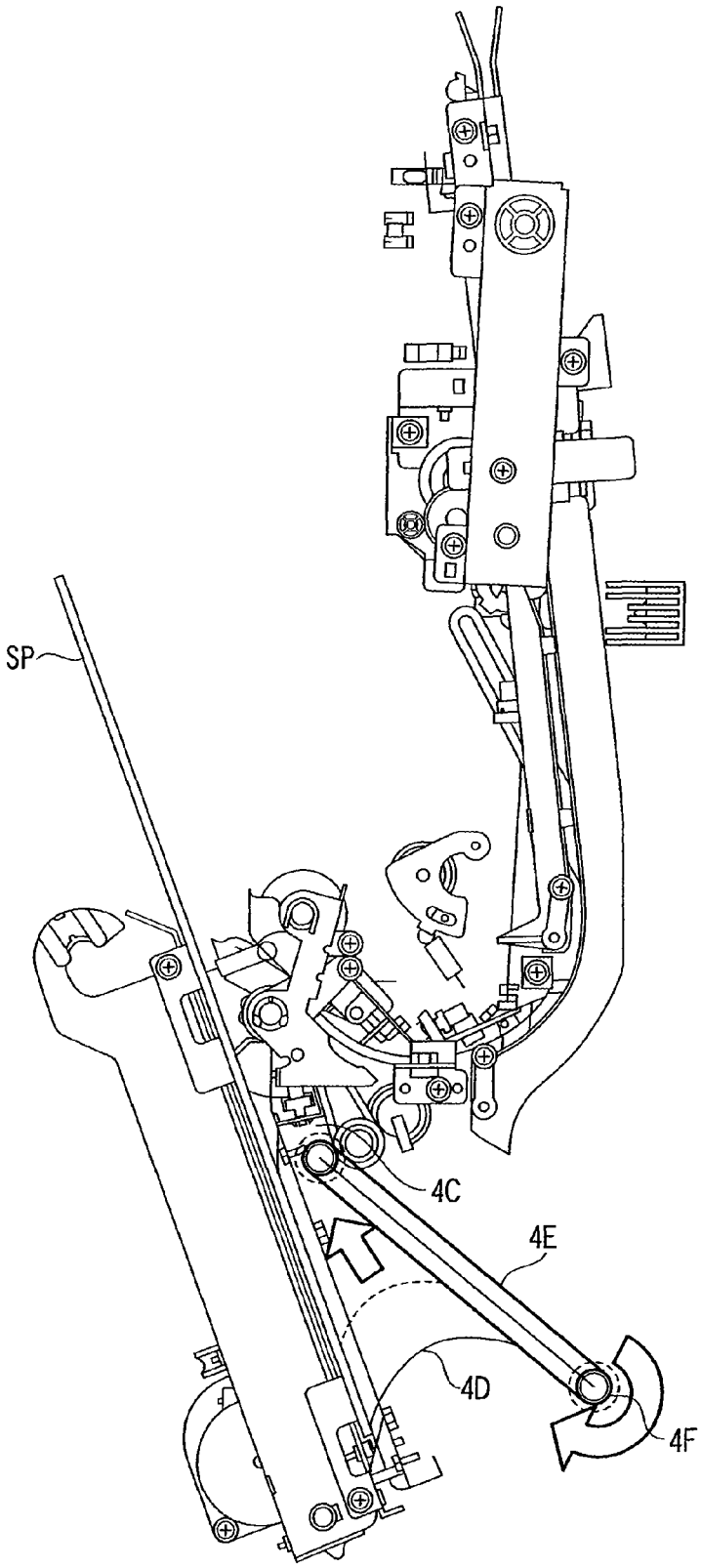
FIG. 23 is an exemplary view showing a modification of the sheet pressing unit shown in FIG. 3.

FIG. 23 shows a modification of the sheet pressing unit 4 shown in FIG. 3. In this modification, the sheet pressure plate 4A shown in FIG. 3 is replaced by a sheet pressure film 4D. The sheet pressure film 4D pushes a stack of sheets SP supported by the stack plate 1 and the stacker 5A. The sheet pressure film 4D pushes the stack of sheets SP toward the stack plate 1 side. A wind-up roll 4F winds up one end of the sheet pressure film 4D. An axis of the wind-up roll 4F may be stationary with the stack plate 1. The belt 4E drives the wind-up roll 4F. The other end of the sheet pressure film 4D may be stationary with the stack plate 1. The sheet pressure film 4D curls to the stack plate 1 side. The wind-up roll 4F winds up the sheet pressure film 4D to decrease a contact area of the sheet pressure film 4D with the stack of sheets SP. The wind-up roll 4F winds out the sheet pressure film 4D to increase the contact area of the sheet pressure film 4D with the stack of sheets SP.

The axis of the wind-up roll 4F may set lower than an upper end of the stack of sheets SP supported by the stacker 5A. The sheet pressure film 4D may curl upwardly. The wind-up roll 4F may wind out the sheet pressure film 4D to raise a top of a curl portion of the sheet pressure film 4D. The contact area of the sheet pressure film 4D with the stack of sheets SP may increase according to rising the top of the curl portion of the sheet pressure film 4D. The wind-up roll 4F may wind up the sheet pressure film 4D to lower the top of the curl portion of the sheet pressure film 4D. The contact area of the sheet pressure film 4D with the stack of sheets SP may decrease according to lowering the top of the curl portion of the sheet pressure film 4D. The sheet pressure film 4D is apart from the stack plate 1 each time the stacker 5A receives a sheet. The sheet pressure film 4D presses the sheet after the longitudinal center of the sheet arrives at the stapling position. Further, the sheet pressure plate 4A is again returned to the standby position after execution of stapling, and is again set to the sheet pressing position after the longitudinal center of the stack of sheets SP is arrived at the folding position. Even when the sheet pressure film 4D is used as stated above, the stack of sheets SP can be pressed similarly to the sheet pressure plate 4A.

Hereinafter, merits obtained in this embodiment will be described.

Sheets sequentially ejected from the belt conveying section 7 are slid down along the inclined stack plate 1 by their own weight at the time of stacking, and stacked on the stack plate 1 as a stack of sheets SP supported by the stacker 5A. This stack of sheets SP is lifted up and down by the stacker 5A at the time of sheet conveying. At the time of sheet stacking or sheet conveying, for example, the sheet pressure plate 4A is located at the standby position sufficiently apart from the sheet loading surface 101, thereby securing a wide sheet path between the sheet loading surface 101 and the sheet pressure plate 4A. This makes defective conveying such as a sheet jam difficult to occur at the time of sheet conveying. As a result of securing the wide sheet path, buckling of the stack of sheets SP at the time of sheet stacking becomes liable to occur. However, since the sheet pressure plate 4A is set to the sheet pressing position after the sheet stacking, the buckling of the stack of sheets SP can be eliminated. Further, even if sheets which are liable to be curled are stacked as a stack of sheets SP, this curl can be eliminated. When the buckling or curl is eliminated as stated above, the position accuracy of the stack of sheets SP moved to the stapling position or the folding position can be improved. Further, since the stack of sheets SP is pressed by the sheet pressure plate 4A before the stapling or the sheet folding, these processes can be stably performed. Further, since the sheet pressure plate 4A starts to press the stack of sheets SP from its lower end side, the buckled or curled stack of sheets SP can be finely extended without generating wrinkles. Moreover, the sheet pressure plate 4A can be driven by the simple drive device.

As shown in FIG. 12, only when it is confirmed that the stack of sheets SP arrived at the stapling position has a sheet size large enough to use the sheet pressure plate 4A, the stack of sheets SP is pressed by the sheet pressure plate 4A, and stapling is performed in this state. That is, since pressing the stack of sheets SP and returning the sheet pressure plate 4A to the standby position are omitted for the stack of sheets SP having such a small sheet size that the lower end does not contact the sheet pressure plate 4A, the total processing time for the stack of sheets SP can be shortened. Further, in the sheet condition such as a thin type in which curl is liable to occur or a large number of sheets to be stapled, the high speed of the sheet pressure plate drive device becomes a cause of occurrence of a sheet jam or defective stapling. However, in pressing the stack of sheets SP shown in FIG. 14, the low-speed operation of the sheet pressure plate drive device is selected when it is confirmed that the stack of sheets SP is in the sheet condition as stated above. Thus, a portion where a large torque is obtainable in the drive device such as a motor is used for the sheet pressing, so that the foregoing problem can be prevented in pressing the stack of sheets SP. On the other hand, when it is confirmed that the stack of sheets SP is in the sheet condition where the foregoing problem does not occur, the high-speed operation of the sheet pressure plate drive device is selected normally. Accordingly, the total process time for the stack of sheets SP as stated above can be shortened. Further, the sheet pressure plate drive device drives the sheet pressure plate 4A at low speed only at the start of operation in pressing the stack of sheets SP shown in FIG. 12, and gradually accelerates the moving speed of the sheet pressure plate 4A, or moves the sheet pressure plate from the sheet pressing position to the standby position in a shorter time than that of the case of sheet pressing in the sheet pressure plate standby shown in FIG. 12. Accordingly, also with these drive manners, the total processing time can be shortened.

Even if the sheet size allows the stack of sheets SP to be pressed in any of the stapling position and the sheet folding position by the sheet pressure plate 4A, after the start of the sheet pressure plate drive motor 4C of the sheet pressure plate 4A, there occurs a difference in the time required for the sheet pressure plate 4A to actually contact the stack of sheets SP. Since this time difference can be previously calculated from the sheet size, in view of the free running time of the sheet pressure plate 4A corresponding to the position of the stack of sheets SP, control is performed to optimize the drive start timing of the sheet pressure plate drive motor 4C of the sheet pressure plate 4A with respect to the lateral alignment motor 6C. That is, the drive timing of the sheet pressure plate drive motor 4C is made early by the free running time of the sheet pressure plate 4A which is increased when the stack of sheets SP set at the stapling position is pressed, and wasteful time consumption is reduced. Accordingly, the time required for pressing the stack of sheets SP can be shortened.

The pair of uprising members GA makes the height conditions of the stack of sheets SP at the upper side and the lower side of the sheet folding unit 3 substantially equal to each other, and this uniforms the asymmetric distortion of the stack of sheets SP generated by the step between the sheet loading surface of the sheet conveying guide G and the sheet loading surface 101. In addition, since the stapler 2 and the sheet folding unit 3 can be disposed to be close to each other, the sheet folding apparatus can be constructed to be very compact.

The lateral alignment unit 4 has the structure in which the support base members BM of the lateral alignment plates 6A and 6B are disposed at the back of the stack plate 1, or the arch-shaped conductive member BMX is disposed to stride the support base members BM of the lateral alignment plates 6A and 6B disposed to be exposed on the sheet loading surface 101. When the support base members BM are at the back of the stack plate 1, the support base members BM do not contact the stack of sheets SP in the lateral alignment operation. Further, the arch-shaped conductive members BMX contact only a part of the stack of sheets SP. Accordingly, sliding of the stack of sheets SP is improved and adhesion by static electricity can be removed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A sheet folding apparatus comprising:

a sheet supporting member which has an inclined surface to support a stack of sheets;

a sheet position adjuster which adjusts a position of the stack of sheets along the inclined surface;

a sheet pressing unit which presses the stack of sheets against the inclined surface;

a folding unit which folds the stack of sheets pressed by the sheet pressing unit; and a controller which controls the sheet pressing unit to press the stack of sheets on the sheet position adjuster against the inclined surface, and to create a gap between the stack of sheets on the sheet position adjuster and the sheet pressing unit to receive a sheet onto the sheet position adjuster, wherein the sheet pressing unit includes a sheet pressure member and a drive mechanism which moves the sheet pressure member from a standby position apart from the inclined surface to a sheet pressing position close to the inclined surface to press the stack of sheets, and the controller controls the drive mechanism to operate at a first speed for a first kind of sheet and controls the drive mechanism to operate at a second speed higher than the first speed for a second kind of sheet different from the first kind of sheet.

2. The apparatus of claim 1, wherein the folding unit includes a folding blade which pushes the stack of sheets to create a fold on the stack of sheets.

3. The apparatus of claim 1, wherein the folding unit includes: a pair of folding rollers which has a nip, and a folding blade which pushes the stack of sheets into the nip.

4. The apparatus of claim 1, wherein the folding unit folds the stack of sheets in a state where the sheet pressing unit presses the stack of sheets against the inclined surface.

5. The apparatus of claim 1, wherein a moving speed of the sheet pressure member moving from the standby position to the sheet pressing position is accelerated to the first speed.

6. The apparatus of claim 1, wherein a moving time of the sheet pressure member moving from the sheet pressing position to the standby position is set to be shorter than a moving time of the sheet pressure member moving from the standby position to the sheet pressing position.

7. The apparatus of claim 1, further comprising a stapler which staples the stack of sheets set at a stapling position by the sheet position adjuster, wherein the controller controls the sheet pressing unit to press the stack of sheets when the stack of sheets arrives at one of the stapling position and the folding position.

8. The apparatus of claim 1, further comprising a stapler which staples the stack of sheets, wherein the controller controls the sheet pressing unit to create a gap between a first sheet on the sheet position adjuster and the sheet pressing unit to guide a second sheet to the sheet position adjuster, to press the second sheet on the sheet position adjuster against the first sheet after the sheet position adjuster receives the second sheet, to create a gap between the second sheet on the sheet position adjuster and the sheet pressing unit after the stapler staples the first sheet and the second sheet on the sheet position adjuster, and to press the first sheet and the second sheet stapled by the stapler before the folding unit folds the first sheet and the second sheet.

9. The apparatus of claim 8, wherein the controller controls the sheet pressing unit to press the second sheet on the sheet position adjuster at a first position against the first sheet after the sheet position adjuster receives the second sheet, and to press the first sheet and the second sheet, which are stapled by the stapler, on the sheet position adjuster at a second position different from the first position before the folding unit folds the first sheet and the second sheet.

10. The apparatus of claim 1, wherein the controller controls the sheet pressing unit to keep a gap between a sheet on the sheet position adjuster and the sheet pressing unit during a term from when the sheet position adjuster receives the sheet to when the folding unit folds the sheet if the sheet is shorter than a predetermined size.

11. An image forming apparatus comprising:

a printer which prints an image on a sheet;

a sheet supporting member which has an inclined surface to support a stack of sheets including the sheet;

a sheet position adjuster which adjusts a position of the stack of sheets along the inclined surface;

a sheet pressing unit which presses the stack of sheets against the inclined surface;

a folding unit which folds the stack of sheets pressed by the sheet pressing unit; and a controller which controls the sheet pressing unit to press the stack of sheets on the sheet position adjuster against the inclined surface, and to create a gap between the stack of sheets on the sheet position adjuster and the sheet pressing unit to receive a sheet onto the sheet position adjuster, wherein the sheet pressing unit includes a sheet pressure member and a drive mechanism which moves the sheet pressure member from a standby position apart from the inclined surface to a sheet pressing position close to the inclined surface to press the stack of sheets, and the controller controls the drive mechanism to operate at a first speed for a first kind of sheet and controls the drive mechanism to operate at a second speed higher than the first speed for a second kind of sheet different from the first kind of sheet.

12. The apparatus of claim 11, wherein the folding unit includes a folding blade which pushes the stack of sheets to create a fold on the stack of sheets.

13. The apparatus of claim 11, wherein the folding unit includes: a pair of folding rollers which has a nip, and a folding blade which pushes the stack of sheets into the nip.

14. The apparatus of claim 11, wherein the folding unit folds the stack of sheets in a state where the sheet pressing unit presses the stack of sheets against the inclined surface.

15. The apparatus of claim 11, further comprising a stapler which staples the stack of sheets, wherein the controller controls the sheet pressing unit to create a gap between a first sheet on the sheet position adjuster and the sheet pressing unit to guide a second sheet to the sheet position adjuster, to press the second sheet on the sheet position adjuster against the first sheet after the sheet position adjuster receives the second sheet, to create a gap between the second sheet on the sheet position adjuster and the sheet pressing unit after the stapler staples the first sheet and the second sheet on the sheet position adjuster, and to press the first sheet and the second sheet stapled by the stapler before the folding unit folds the first sheet and the second sheet.

16. The apparatus of claim 11, wherein the controller controls the sheet pressing unit to keep a gap between a sheet on the sheet position adjuster and the sheet pressing unit during a term from when the sheet position adjuster receives the sheet to when the folding unit folds the sheet if the sheet is shorter than a predetermined size.

17. A sheet folding apparatus comprising:

a sheet supporting member which has an inclined surface to support a stack of sheets;

a sheet position adjuster which adjusts a position of the stack of sheets along the inclined surface;

a sheet pressing unit which presses the stack of sheets against the inclined surface;

a folding unit which folds the stack of sheets pressed by the sheet pressing unit; and a controller which controls the sheet pressing unit to press the stack of sheets on the sheet position adjuster against the inclined surface, and to create a gap between the stack of sheets on the sheet position adjuster and the sheet pressing unit to receive a sheet onto the sheet position adjuster, wherein the sheet pressing unit includes a sheet pressure member and a drive mechanism which moves the sheet pressure member from a standby position apart from the inclined surface to a sheet pressing position close to the inclined surface to press the stack of sheets, and the controller is configured to advance a drive start timing of the drive mechanism of the sheet pressing unit when a time required for contact between the sheet pressure member and the stack of sheets becomes long by a difference in setting position of the stack of sheets.

18. The apparatus of claim 17, wherein the folding unit includes: a pair of folding rollers which has a nip, and a folding blade which pushes the stack of sheets into the nip.

19. The apparatus of claim 17, wherein the folding unit folds the stack of sheets in a state where the sheet pressing unit presses the stack of sheets against the inclined surface.

* * * * *